United States Patent [19]

Kuse et al.

[11] Patent Number: 5,063,140

[45] Date of Patent: Nov. 5, 1991

[54] METHOD FOR PROCESSING SILVER HALIDE COLOR PHOTOGRAPHIC LIGHT-SENSITIVE MATERIALS

[75] Inventors: Satoru Kuse; Masao Ishikawa; Shigeharu Koboshi; Minoru Ishikawa; Toshihiko Yagi, all of Hino, Japan

[73] Assignee: Konica Corporation, Tokyo, Japan

[21] Appl. No.: 508,786

[22] Filed: Apr. 12, 1990

Related U.S. Application Data

[63] Continuation-in-part of Ser. No. 309,818, Feb. 10, 1989, abandoned.

[30] Foreign Application Priority Data

Feb. 15, 1988 [JP] Japan ..... 63-32501
Mar. 9, 1988 [JP] Japan ..... 63-55855

[51] Int. Cl.[5] ..... G03C 5/44

[52] U.S. Cl. ..... 430/393; 430/430; 430/461; 430/496

[58] Field of Search ..... 430/393, 430, 461, 496

[56] References Cited

U.S. PATENT DOCUMENTS 4,804,618 2/1989 Ueda et al. ..... 430/393
4,833,069 5/1989 Hamada et al. ..... 430/496

FOREIGN PATENT DOCUMENTS 63-97953 4/1988 Japan ..... 430/430
63-250651 10/1988 Japan ..... 430/430

*Primary Examiner*—Charles L. Bowers, Jr.
*Assistant Examiner*—Janet C. Baxter
*Attorney, Agent, or Firm*—Jordan B. Bierman

[57] ABSTRACT

A method for forming color photographic images is disclosed. The method comprises steps of imagewise exposing to light a silver halide color photographic light-sensitive material developing the light-sensitive material with a color developer, bleaching, immediately after the step of developing, the light-sensitive material with a bleacing solution, and treating the bleached light-sensitive material with a solution having fixing capablility, wherein the light-sensitive material comprises a support and hydrophilic colloid layers including a silver halide emulsion layer provided on a side of the support, and a total dry thickness of the hydrophilic colloid layers is not more than 17 μm, and the bleaching solution contains a ferric complex salt of a compound represented by the following formula in an amount of within the range of from 0.002 mole to 9.4 mole per liter of the bleaching solution;

wherein $A_1$, through $A_4$ are each a $—CH_2OH$ group, a —COOM, or a $—PO_3M^1M^2$. Color photographic images can be obtained, which is excellent in image sharpness and improved in bleach-fog desilvering property and preservcapability, with diminished amount of developer replenishing.

16 Claims, No Drawings

METHOD FOR PROCESSING SILVER HALIDE COLOR PHOTOGRAPHIC LIGHT-SENSITIVE MATERIALS

This Application is a Continuation-in-Part of Ser. No. 309,818, filed Feb. 10, 1989, and now abandoned.

FIELD OF THE INVENTION

This invention relates to a method for processing a silver halide color photographic light-sensitive material and, more particularly, to a method for processing a silver halide color photographic light-sensitive material improved in image-sharpness. bleach-fogginess, image-preservability and desilvering property.

BACKGROUND OF THE INVENTION

As for one of the means for improving sharpness of a color photographic light-sensitive material, how to make the photographic component layers of the light-sensitive material thinner has been studied variously. Particularly, in a silver halide emulsion layer more closer to a support, a light scattering path from the surface of the light-sensitive material to the emulsion layer becomes longer. It has, therefore, been known as an effective means for improving image-sharpness to make a layer thinner by reducing the binder content of a light-sensitive material. To which, Journal of the Optical Society of America, 58, (9), pp. 1245–1256, 1968; Photographic Science and Engineering, 16, <3>, pp. 181–191, 1972; and so forth may be referred.

As for the typical means for making a layer thinner, there are well-known means such as the means in which the amounts of gelatin, a coupler and/or a high-boiling solvent for dispersing couplers are diminished and, besides, another means in which the so-called polymer couplers or the like are used. However, any of these means is not desirable from the viewpoint of displaying the photographic characteristics, because the preservability of light-sensitive materials is deteriorated.

On the other hand, there are the other difficulties in making layers thinner. According to the studies made by the present inventors, for example, it became apparent that the troubles such as a faulty desilvering is actualized in a bleaching step if a layer thickness is thinned to be not thicker than 17 μm, though the thickness of the emulsion layers of ordinary type color light-sensitive materials is from 20 to 30 μm. There is still no verification of the reason why the faulty desilvering is actualized by making an emulsion layer thinner, however, it may be supposed that the properties of developed silver are delicately varied by increasing the proportion of silver to binders contained in the emulsion layers when making the layers thinner, so that the faulty desilvering may be taken place.

Fundamentally, the methods each for processing silver halide color photographic light-sensitive materials are comprised of the two processes, namely, a color developing process and a desilvering process. The desilvering process is usually comprised of a bleaching step and another step such as a fixing or bleach-fixing step in which a fixing function may be displayed. Besides the above steps, other additional steps such as a rinsing, stabilizing or the like steps may usually be added to the process.

Metal complex salts of organic acids, such as the metal complex salts of aminopolycarboxylic acid and so forth, have so far been used as the oxidizers for bleaching image-forming silver, because they have little pollution troubles and meet the requirements for recovering waste liquids. However, the processing solutions each containing such metal complex salts of organic acids have a defect that image-forming silver, i.e., metallic silver, is bleached at a substantially low rate, i.e., an oxidizing rate, because the oxidizing speed thereof is usually slow. There is a defect that it takes a long time to perform a bleaching step particularly with a high-speed silver halide color photographic light-sensitive material comprising principally a silver bromide or silver iodobromide emulsion, a highly silver-containing color photographic paper, a color photographic negative or reversal film for photograph-taking.

In the methods for continuously processing a number of silver halide photographic light-sensitive materials with an automatic processor or the like, it is required to provide a means for keeping constant the concentration of the components of a processing solution so as to prevent the functions of the bleaching solution from being deteriorated by the variations of the component concentration. For this purporse, there have been some proposals, such as the so-called concentrated low replenishment system in which a replenisher is concentrated and is then replenished in a small amount, another system in which an over-flown solution is added with a regenerating agent so as to serve again as a replenisher, and so forth.

Among the bleaching solutions in particular, there is a method having been put to practical use, in which a ferrous organic acid complex salt produced by bleaching developed silver is oxidized to be a ferric organic acid complex salt and a regenerating agent for compensating a shortage so that it may be used to serve again as a replenisher.

However, at the so-called compact-sized laboratories (which are sometimes called 'mini-labs' as a byname) recently having been popularized, there are serious needs for simplifying photofinishing processes and economizing the narrow installation space for a processor. It is, therefore, particularly undesirable to provide a regeration system which requires a troublesome labor and control as well as an extra space for regenerating process.

It is, therefore, preferable to provide the above-mentioned concentrated low-replenishing system, however, this system has the defects that a bleaching reaction is inhibited when an amount of a bleaching solution replenished is too much diminished, because the concentration of the components of a color developer brought into the bleaching solution becomes higher and, more seriously, that a bleach-fog is produced and an image-preservability is deteriorated.

The problems of the above-mentioned bleach-fog and image-preservability deterioration have become more notorious particularly in the case of the recent low-replenishment of a color developer. In other words, these problems have become more serious at the present stage where a further lower replenishment is demanded to materialize a low pollution and to save costs.

SUMMARY OF THE INVENTION

It is, therefore, an object of the invention to provide a method for processing a silver halide color photographic light-sensitive material which is excellent in image-sharpness, improved in bleach-fog, desilvering property and image preservability, and capable of diminishing an amount of a color developer replenished, upon solution of the above-mentioned problems.

The above-mentioned objects of the invention can be accomplished with a method for forming color photographic images comprising steps of imagewise exposing to light a silver halide color photo-graphic light-sensitive material. developing the light-sensitive material with a color developer, bleaching, immediately after the step of developing, the light-sensitive material with a bleaching solution, and treating, after the step of bleaching, the light-sensitive material with a solution having fixing capability, wherein the light-sensitive material comprises a support and hydrophilic colloid layers including a silver halide emulsion layer provided on a side of the support, and a total dry thickness of the hydrophilic colloid layers is not more than 17 μm, and the bleaching solution contains a ferric complex salt of a compound represented by the following formula A in an amount of within the range of from 0.002 mole to 0.4 mole per liter of the bleaching solution;

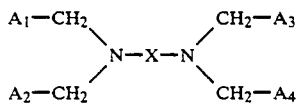

Formula A wherein $A_1$ through $A_4$ are each a $—CH_2OH$ group, a —COOM group, or a $—PO_3M^1M^2$ group, which may be the same with or different each other. M, $M^1$ and $M^2$ are each a hydrogen atom, a sodium atom, a potassium atom or an ammonium group; X is a substituted or unsubstituted alkylene group having three to five carbon atoms.

DETAILED DESCRIPTION OF THE INVENTION

Now, the invention will be detailed below. First, the compounds represented by the above-given Formula-A, which is contained in the bleaching solution used in the processing method of the invention, will be detailed.

As mentioned before, $A_1$ through $A_4$ may be the same with or the different from each other, and they represent each $—CH_2OH$, —COOM or $—PO_3M^1M^2$ in which M, $M^1$ and $M^2$ each represent a hydrogen atom, a sodium atom, a potassium atom or an ammonium group; X represents a substituted or unsubstituted alkylene group having 3 to 5 carbon atoms, such as a propylene group and a pentamethylene group; and the substituents include, for example, a hydroxyl group.

The preferable examples of the compounds represented by the foregoing Formula-A include the following compounds.

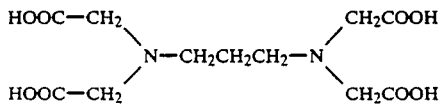

A-1

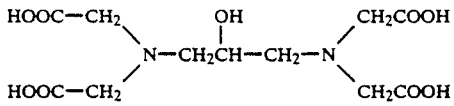

A-2

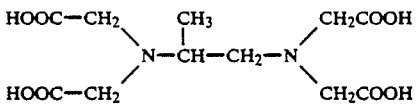

A-3

-continued

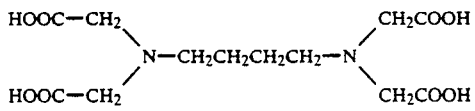

A-4

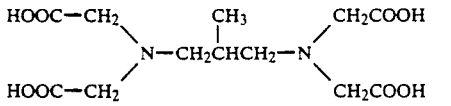

A-5

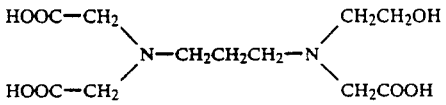

A-6

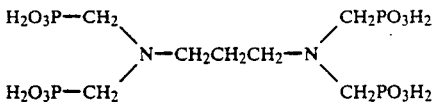

A-7

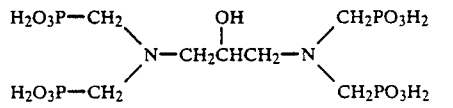

A-8

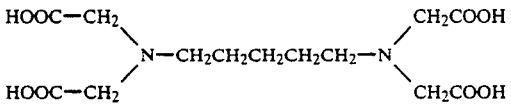

A-9

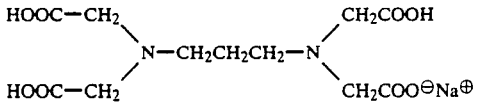

A-10

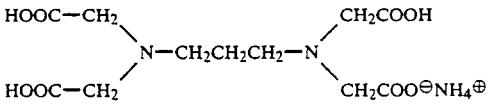

A-11

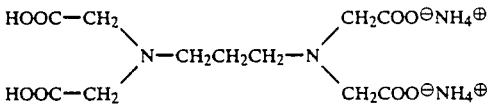

A-12

The compounds represented by Formula-A include the compounds A-1 through A-1 and, besides, the sodium, potassium or ammonium salts thereof. In particular, the ferric ammonium complex salts thereof may preferably be used for a bleaching agent.

Among the examples of the above-given compounds, the particularly preferable compounds include A-1, A-2, A-3, A-4 and A-7 and, inter alia, A-1.

Ferric complex salts of the compounds represented by the foregoing Formula-A, may be used in an amount within the range of from 0.002 to 0.4 mol per liter of a bleaching solution, more preferably, from 0.01 to 0.4 mol and, inter alia, from 0.05 to 0.38 mol.

In the invention, a bleaching solution is used by adding thereto at least one kind of the ferric complex salts of the compounds represented by Formula-A and, besides, other ferric aminopolycarboxylic acid complex salts such as ferric ethylenediaminetetraacetic acid complex salt, ferric diethylenetriaminepentaacetic acid complex salt, ferric 1,2-cyclohexanediaminetetraacetic acid complex salt, ferric glycoletherdiaminetetraacetic acid complex salt and so forth may also be used in combination. Inter alia, the combination of the ferric complex salt of the invention and ferric ethylenediaminetetraacetic acid complex salt is preferably used from the viewpoints of economization and bleach-fog diminution. In this case, a proportion of the former to the latter is not less than 50 mol%.

In the invention, a bleaching solution may be replenished in an amount within the range of, preferably, from 20 to 500 ml per sq. meter of a silver halide color photographic light-sensitive material to be processed, more preferably, from 30 to 350 ml, further preferably, from 40 to 300 ml and, most preferably, from 50 to 250 ml Next, silver halide color photographic light-sensitive materials to which the processing method of the invention may be applied will be detailed.

In the silver halide color photographic light-sensitive material which is to be processed according to the invention, an aggregate dried layer thickness of all the hydrophilic colloidal layers thereof is not thicker than 17 μm on the side of the support bearing thereon a silver halide emulsion layer.

The limitation that the above-mentioned aggregate dried layer thickness is not thicker than 17 μm should be applied only to an aggregate dried layer thickness of all the hydrophilic colloidal layers provided to the side of the support bearing thereon a silver halide emulsion layer. In other words, if the other side of the support bears only any other layers than emulsion layers thereon, the thickness of such layers may not be limitative.

The term, dried thickness stated herein means a layer thickness measured under the conditions of 23° C. and 55%RH. Each layer thickness may be measured in such a manner that the cross section of a dried sample is magnified and photographed with a scanning type electron microscope and the resulted layer thickness is measured.

The lower limit of an aggregate dried layer thickness of the whole hydrophilic colloidal layer depends limitedly on a volume occupied by an additive or binders such as gelatin or the like. Such aggregate dried layer thickness are within the range of, preferably, from 5 to 17 μm and, more preferably, from 10 to 16 μm. A thickness from the uppermost surface on the side of a support provided with an emulsion layer to the bottom of the emulsion layer which is the closest to the support is, preferably, not thicker than 15 μm and, more preferably, 5 to 15 μm. A thickness from the above-mentioned uppermost surface to the bottom of the emulsion layer which has a color-sensitivity different from that of the the layer closest to the support and is the second closest to the support is, preferably, not thicker than 10 μm.

In the silver halide color photographic light-sensitive materials applicable to the invention, an aggregate light-sensitive silver halide content of all the emulsion layers thereof is, preferably, from 0.5 g/m$^2$ to 4.7 g/m$^2$ in terms of a silver content and, more preferably, from 1.0 g/m$^2$ 4.7 g/m$^2$. The lower limit of a light-sensitive silver halide content of at least one silver halide emulsion layer may be any other than zero. Such light-sensitive silver halides may be contained in any amount, provided that the aggregate light-sensitive silver halide content of all the silver halide emulsion layers should be from 0.5 g/m$^2$ to 4.7 g/m$^2$ in terms of silver content.

In the invention, any silver content may be measured in an atomic absorption analysis method.

There is no special limitation to the light-sensitive materials applicable to the invention, except the limitation to the aforementioned dried layer thickness. Among such light-sensitive materials, those preferably applicable to the invention include, for example, a color negative film, and a color reversal film. Further, the invention may preferably be applied to a light-sensitive material containing an emulsion having an average silver iodide content of from 1 to 20 mol% and, preferably, from 1 to 15 mol%. In particular, the invention may be applied to a light-sensitive material containing a core/shell type emulsion having the above-given average silver iodide content.

In the processing method of the invention, immediately after an imagewise exposed silver halide color photographic light-sensitive material is color-developed, it is processed with a bleaching solution and is then successively processed with a processing solution having a fixing capability.

The processing methods such as mentioned above will be detailed.

The typical processing steps of the processing method will be exemplified as follows.

(1) Color-developing - Bleaching - Fixing - Washing,
(2) Color-developing - Bleaching - Fixing - Washing - Stabilizing,
(3) Color-developing - Bleaching - Fixing - Stabilizing.
(4) Color-developing - Bleaching - Fixing - Primary stabilizing - Secondary stabilizing.
(5) Color-developing - Bleaching - Bleach-fixing - Washing,
(6) Color-developing - Bleaching - Bleach-fixing - Washing - Stabilizing,
(7) Color-developing - Bleaching - Bleach-fixing - Stabilizing, and
(8) Color-developing - Bleaching - Bleach-fixing - Primary stabilizing - Secondary stabilizing.

Among the above-given steps, the steps (3), (4), (7) and (8) are preferable and, inter alia, the steps (3) and (4) are more preferable.

To give an example of the other preferable embodiments of the methods of the invention, there is a method in which a part or the whole of the over-flow of a color developer is made flowed into a bleaching solution used in a bleaching step that is the successive step of a developing step. The reason why this method is given as an example is that a sludge is inhibited from producing in the bleaching solution when a certain amount of the color developer is made flowed into the bleaching solution.

In addition to the above-mentioned method, if a part or the whole of the over-flow of a stabilizer is made flowed from the subsequent step into either a bleach-fixer or a fixer, a silver recovery efficiency may be improved excellently.

When processing a silver halide color photographic light-sensitive material with a color developer, the processing time should preferably be within the range of not longer than 180 seconds, not longer than 150 seconds, from 20 to 150 seconds, from 30 to 120 seconds, and from 40 to 100 seconds. The latter, the better.

When a silver halide color photographic light-sensitive material is processed within such a short time as mentioned above, the graininess of dye images resulted may also be improved.

The above-mentioned color developer contains an aromatic primary amine type color developing agent in an amount within the range of, preferably, not less than $1.5\times10^{-2}$ mol per liter of the color developer, more preferably, not less than $2.0\times10^{-2}$ mol, further preferably, from $2.5\times10^{-2}$ to $2\times10^{-3}$ and, most preferably, from $3\times10^{-2}$ to $1\times10^{-1}$ mol.

When a photographic light-sensitive material is activated by increasing the concentration of such a color developing agent as mentioned above, images having an excellent sharpness and an improved graininess may be obtained in a short time process as mentioned above. In particular, this effect is remarkable in magenta dye images.

Now, the color developing agents preferably applicable to color developers will be detailed below.

Aromatic primary amine type color developing agents are preferably used in color developers. Such color developing agents include publicly known ones being widely applied to various color photographic processes. These color developing agents also include the derivatives of the aminophenol and p-phenylenediamine types. These compounds are used in the form of, for example, a hydrochloride or a sulfate, because these compounds are generally more stable in the form of a salt than in a free state.

Such aminophenol type developing agents include, for example, o-aminophenol, p-aminophenol, 5-amino-2-oxytoluene, 2-amino-3-oxytoluene, 2-oxy-3-amino-1,4-dimethylbenzene, and so forth.

The aromatic primary amine type color developing agents particular useful for improving a crystal-deposition on the inner walls of the color developing tanks of an automatic processor include an aromatic primary amine type color developing agents having an amino group having at least one water-solubility-providing group and, more preferably, the compounds represented by the following Formula-E.

Formula-E

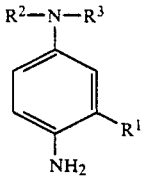

wherein $R^1$ represents a hydrogen atom, a halogen atom or an alkyl group which is a straight-chained or branched alkyl group having 1 to 5 carbon atoms, and such alkyl group includes those having a substituent; $R^2$ and $R^3$ represent each a hydrogen atom, an alkyl group or an aryl group, including those having a substituent, and at least one of the $R^{2\,l\,and\,R3}$ is an alkyl group substituted with a water-solubility-providing group such as a hydroxyl group, a carboxylic acid group, a sulfonic acid group, an amino group, a sulfonamido group and so forth or $\left[(CH_2)_q O\right]_p R^4$. The alkyl groups include those having a further substituent;

$R^4$ represents a hydrogen atom or an alkyl group which is a straight-chained or branched alkyl group having 1 to 5 carbon atoms, and p and q are each an integer of 1 to 5.

Next, the compounds represented by the above-given Fomula-E will be exemplified below. It is, however, to be understood that the compounds and the invention shall not be limited thereto.

Exemplified compounds (E-1)

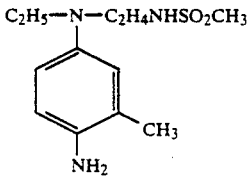

(E-2)

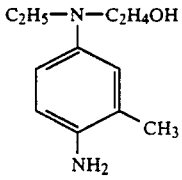

(E-3)

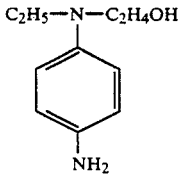

(E-4)

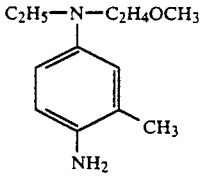

(E-5)

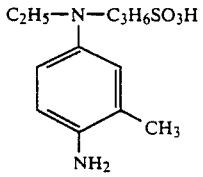

(E-6)

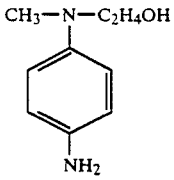

(E-7)

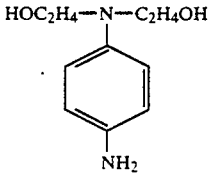

(E-8)

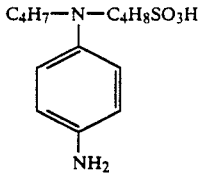

-continued

Exemplified compounds (E-9)

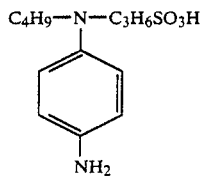

(E-10)

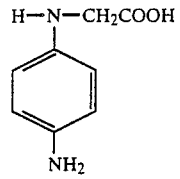

(E-11)

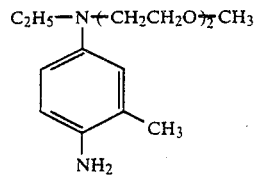

(E-12)

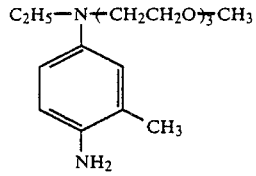

(E-13)

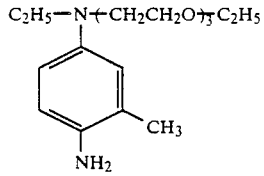

(E-14)

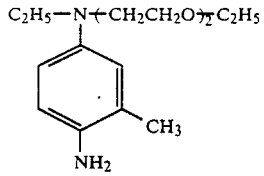

(E-15)

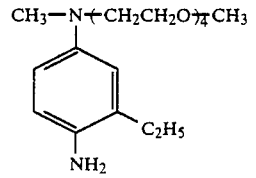

(E-16)

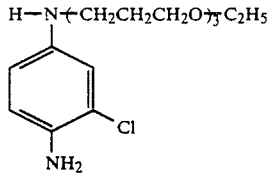

The p-phenylenediamine derivatives represented by Formula-E may be used in the form of the salts of an organic acid or an inorganic acid, including, for example, a hydrochloride, a sulfate, a phosphate, a p-toluenesulfonate, a sulfite, an oxalate, a benzenedisulfonate and so forth.

Among the p-phenylenediamine derivatives represented by the foregoing Formula-E, those having $R^2$ and/or $R^3$ each representing $\{(CH_2)_q-O\}_p-R^4$ in which p, q and $R^4$ are each synonymous with those given before are particularly preferable.

The compounds preferably applicable to a color developer include, for example, a sulfite, a hydroxylamine and a development inhibitor. Such sulfites include, for example, sodium sulfite, sodium hydrogensulfite, potassium sulfite, potassium hydrogensulfite and so forth. These sulfites may be used in an amount within the range of, preferably, from 0.1 to 40 g/liter and, more preferably, from 0.5 to 10 g/liter. Such hydroxylamines may be used in the form of a salt such as a hydrochloride, a sulfate and so forth. These hydroxylamines may be used in an amount within the range of, preferably, from 0.1 to 40 g/liter and, more preferably, from 0.5 to 10 g/liter. Such development inhibitors preferably applicable to the above-mentioned color developers include, for example, halides such as sodium bromide, potassium bromide, sodium iodide, potassium iodide and so forthe and, besides the above, an organic development inhibitor. Such development inhibitor may be used in an amount within the range of, preferably, from 0.005 to 20 g/liter and, more preferably, from 0.01 to 5 g/liter.

The color developers are also allowed to freely contain a variety of components usually added thereto including, for example, an alkalizer such as sodium hydroxide, sodium carbonate and so forth, an alkali thiocyanate, an alkali halide, benzyl alcohol, a water softener, a thickener, a development accelerator, and so forth.

Besides the above, the other additives also applicable to the above-mentioned color developers include, for example, an antistaining agent, an antisludging agent, a preservative, an interlayer effect accelerator, a chelating agent, and so forth.

Such color developers should be used at a pH of, preferably, not lower than 9 and, more preferably, from 9 to 13.

A color developing temperature should be kept at a temperature within the range of, preferably, from 20° to 45° C. and, more preferably, from 30° to 45° C. from the viewpoints of the stability of a color developer and a rapid processing.

Next, a bleach-fixers will be detailed, especially in the case where the bleach-fixer is used in the invention to serve as a processing solution having a fixing capability.

The bleaching agents preferably applicable to the bleach-fixers include, for example, the ferric complex salts of aminocarboxylic acid or aminophosphonic acid. Such aminocarboxylic acid and aminophosphonic acid each are an amino compound having at least two or more carboxyl groups or an amino compound having at least two or more phosphonic groups and, more preferably, a compound represented by the following Formula-XII or Formula-XIII.

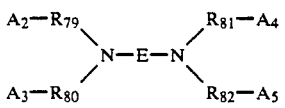

Formula-XII

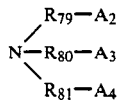

Formula-XIII wherein E represents a substituted or unsubstituted alkylene, cycloalkylene or phenylene group, $—R_{83}OR_{83}OR_{83}—$ or $—R_{83}ZR_{83}—$;

Z represents 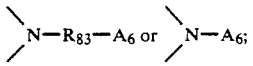

$R_{79}$ through $R_{83}$ each represent a substituted or unsubstituted alkylene group; $A_2$ through $A_6$ each represent a hydrogen atom, —OH, —COOM or $—PO_3M_2$; and M represents a hydrogen atom or an alkali metal atom.

Next, among the compounds represented by the above-given Formula-XII or Formula-XIII, the preferable compounds will be exemplified as follows.

Exemplified compounds

XII-1 Ethylenediaminetetraacetic acid;
XII-2 Diethylenediaminepentaacetic acid;
XII-3 Ethylenediamine-N-(β-hydroxyethyl)-N,N',N'-triacetic acid,
XII-4 1,3-propylenediaminetetraacetic acid;
XII-5 Triethylenetetraminehexaacetic acid,
XII-6 Cyclohexanediaminetetraacetic acid,
XII-7 1,2-diaminopropanetetraacetic acid,
XII-8 1,3-diaminopropane-2-oltetraacetic acid,
XII-9 Ethyletherdiaminetetraacetic acid,
XII-10 Glycoletherdiaminetetraacetic acid,
XII-11 Ethylenediaminetetrapropionic acid,
XII-12 Phenylenediaminetetraacetic acid,
XII-13 Disodium ethylenediaminetetraacetate,
XII-14 Tetra(Tri)methyl ammonium ethylenediaminetetraacetate,
XII-15 Tetrasodium ethylenediaminetetraacetate,
XII-16 Pentasodium diethylenetriaminepentaacetate,
XII-17 Sodium ethylenediamine-N-(β-hydroxyethyl)-N,N',N'-triacetate,
XII-18 Sodium propylenediaminetetraacetate,
XII-19 Ethylenediaminetetramethylenephosphonic acid,
XII-20 Sodium cyclohexanediaminetetraacetate,
XII-21 Diethylenetriaminepentamethylenephosphonic acid,
XII-22 Cyclohexanediaminetetramethylenephosphonic acid,
XIII-1 Nitrilotriacetic acid,
XIII-2 Methyliminodiacetic acid,
XIII-3 Hydroxyethyliminodiacetic acid,
XIII-4 Nitrilotripropionic acid,
XIII-5 Nitrilotrimethylenephosphonic acid,
XIII-6 Iminodimethylenephosphonic acid,
XIII-7 Hydroxyethyliminodimethylenephosphonic acid, and
XIII-8 Trisodium nitrilotriacetate.

Among the aminocarboxylic acid and aminophosphonic acid, the particularly preferable compounds from the viewpoint of the effects of the objects of the invention include those of XII-1, XII-2, XII-4, XII-6, XII-7, XII-10, XII-19, XIII-1 and XIII-5, among which XII-4 is particularly preferable.

The foregoing ferric complex salts of organic acids are used in the form of free salts such as a hydrogen salt; alkali metal salts such as a sodium salt, a potassium salt, a lithium salt and so forth; ammonium salts; or water-soluble amine salts such as a triethanolamine salt and so forth. Among them, potassium salts, sodium salts and ammonium salts are preferably used.

It would be enough to use at least one kind of these ferric complex salts. It is, however, allowed to use them in combination. They may be used in any amount selectively in accordance with the requirements such as those for the silver contents of a light-sensitive material to be processed, the silver halide compositions thereof and so forth.

For instance, they are used in an amount of not less than 0.01 mol per liter of a bleach-fixer used and, preferably, in an amount within the range of from 0.05 to 1.0 mol.

About replenishers, it is preferable to use each of them upon concentrating them up to a level where the solubility thereof is to be at a maximum, because the replenisher is to be concentrated and less replenished.

Where a bleaching solution and bleach-fixer preferably contain imidazole and the derivative thereof or at least one kind of the compounds represented by the following Formulas I through IX as a bleaching accelerator, there also displays an effect preventing the precipitates which are produced due to the presence of the silver contained in the bleaching solution. Therefore, such bleaching solution and bleachfixers should preferably be used.

Formula I

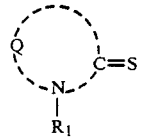

wherein Q represents a group consisting of atoms which are necessary to complete a nitrogen-containing heterocyclic ring including a ring condensed with a 5- or 6-membered unsaturated ring; and $R_1$ represents a hydrogen atom, an alkyl group having 1 to 6 carbon atoms, a cycloalkyl group, an aryl group, a heterocyclic group including those each condensed with a 5- or 6-membered unsaturated ring, or an amino group.

Formula II

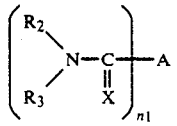

wherein $R_2$ and $R_3$ each represent a hydrogen atom, an alkyl group having 1 to 6 carbon atoms, a hydroxy group, a carboxy group, an amino group, an acyl group having 1 to 3 carbon atoms, an aryl group or an alkenyl group; A represents

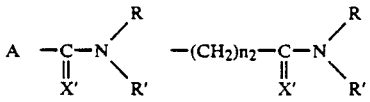

-continued

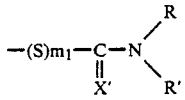

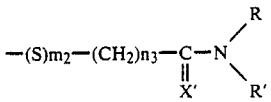

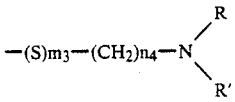

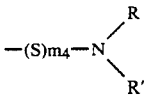

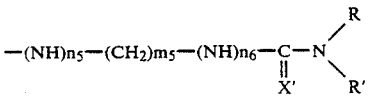

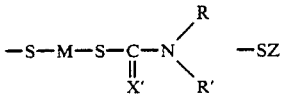

or an $n_1$ valent heterocyclic residual group including those condensed with a 5- or 6-membered unsaturated ring; X represents =S, =O or =NR'', in which R and R' each are synonymous with $R_2$ and $R_3$, X' is synonymous with X, Z represents a hydrogen atom, an alkali metal atom, an ammonium group, an amino group, a nitrogen-containing heterocyclic residual group, an alkyl group, or

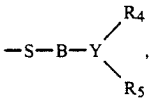

M represents a divalent metal atom, R'' represents a hydrogen atom, an alkyl group having 1 to 6 carbon atoms, a cycloalkyl group, an aryl group, a heterocyclic residual group including those each condensed with a 5- or 6-membered unsaturated ring, or an amino group, $n_1$ to $n_6$ and $m_1$ to $m_5$ each are an integer of 1 to 6, B represents an alkylene group having 1 to 6 carbon atoms, Y represents

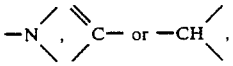

$R_4$ and $R_5$ each are synonymous with $R_2$ and $R_3$, provided that $R_4$ and $R_5$ each may represent —B—SZ and that $R_2$ and $R_3$, R and R' and, $R_4$ and $R_5$ each may also bond together so as to complete a ring.

The compounds represented by the above-given formula include an enolized substance and the salts thereof.

Formula III

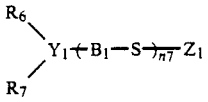

wherein $R_6$ and $R_7$ each represent a hydrogen atom, an alkyl group having 1 to 6 carbon atoms, a hydroxy group, a carboxy group, an amino group, an acyl group having 1 to 3 carbon atoms, an aryl group, an alkenyl group or $—B_1—S—Z_1$, provided that $R_6$ and $R_7$ are allowed to bond together to complete a ring; $Y_1$ represents

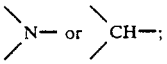

$B_1$ represents an alkylene group having 1 to 6 carbon atoms; $Z_1$ represents a hydrogen atom, an alkali metal atom, an ammonium group, an amino group, a nitrogen-containing heterocyclic residual group or

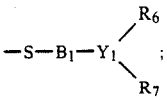

is an integer of 1 to 6.

Formula IV

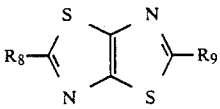

wherein $R_8$ and $R_9$ each represent

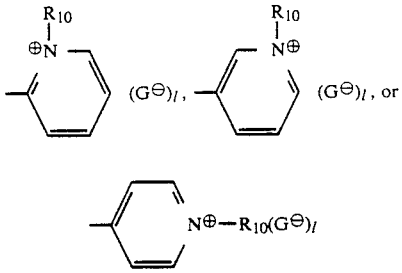

$R_{10}$ represents an alkyl group or $—(CH_2)_{n_8}SO_3^{\theta}$, provided that, when $R_{10}$ is $—(CH_2)_{n_8}SO_3^{\theta}$, l is zero and, when $R_{10}$ is an alkyl group, l is 1; $G^{\theta}$ represents an anion; and $n_8$ is an integer of 1 to 6.

Formula V

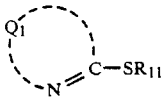

wherein $Q_1$ represents a group consisting of atoms necessary to complete a nitrogen-containing heterocyclic ring including those each condensed with a 5- or 6-membered unsaturated ring; and $R_{11}$ represents a hydrogen atom, an alkali metal atom,

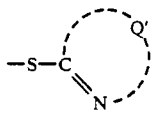

in which Q' is synonymous with $Q_1$, or an alkyl group.

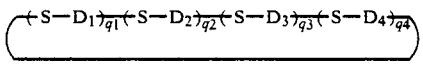

Formula VI wherein $D_1$, $D_2$, $D_3$ and $D_4$ each represent a single linkage, an alkylene group having 1 to 8 carbon atoms or a vinylene group; $q_1$, $q_2$, $q_3$ and $q_4$ each represent an integer of 0, 1 or 2; and a ring formed together with a sulfur atom is further allowed to be condensed with a saturated or unsaturated 5- or 6-membered ring.

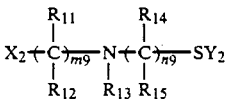

Formula VII wherein $X_2$ represents —COOM', —OH, —$SO_3M'$, —$CONH_2$, —$SO_2NH_2$, —$NH_2$, —SH, —CN, —$CO_2R_{16}$, —$OR_{16}$, —$NR_{16}R_{17}$, —$SR_{16}$, —$SO_3R_{16}$, —$NHCOR_{16}$, —$NHSO_2R_{16}$, or —$COR_{16}$; $Y_2$ represents

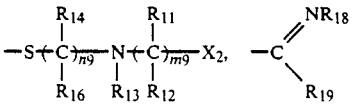

or hydrogen atom; $m_9$ and $n_9$ each are an integer of from 1 to 10; $R_{11}$, $R_{12}$, $R_{13}$, $R_{14}$, $R_{15}$, $R_{17}$ and $R_{18}$ each represent a hydrogen atom, a lower alkyl group, an acyl group or

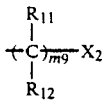

$R_{16}$ represents a lower alkyl group; $R_{19}$ represents —$NR_{20}R_{21}$, —$OR_{22}$ or —$SR_{22}$; $R_{20}$ and $R_{21}$ each represent a hydrogen atom or a lower alkyl group; and $R_{22}$ represents a group consisting of atoms necessary to complete a ring upon bonding to $R_{18}$; $R_{20}$ or $R_{11}$ is allowed to complete a ring upon bonding to $R_{18}$; and M' represents a hydrogen atom or a cation.

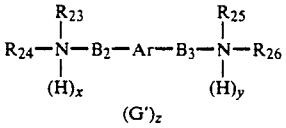

Formula VIII wherein Ar an arylene group or a divalent organic group completed by combining an aryl group with an oxygen atom and/or an alkylene group; $B_2$ and $B_3$ each represent a lower alkylene group; $R_{23}$, $R_{24}$, $R_{25}$ and $r_{26}$ each represent a hydroxy-substituted lower alkyl group: x and y each are an integer of 0 or 1; G' represents an anion: and z is an integer of 0, 1 or 2.

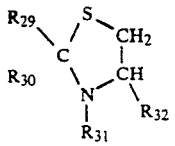

Formula IX wherein $R_{29}$ and $R_{30}$ each represent a hydrogen atom, an alkyl group, an aryl group or a heterocyclic group; $R_{31}$ represents a hydrogen atom or an alkyl group; and $R_{32}$ represents a hydrogen atom or a carboxy group.

The compounds each represented by Formulas I through IX, which are preferably applicable to the invention, are generally used as a bleaching accelerator.

Typical examples of the bleaching accelerators represented by the foregoing Formulas I through IX may be given as follows. It is, however, to be understood that the invention shall not be limited thereto.

Exemplified compounds (I-1)

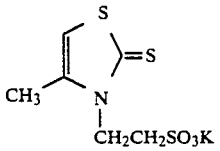

(I-2)

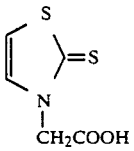

(I-3)

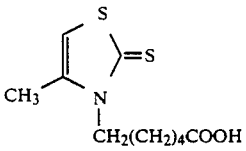

(I-4)

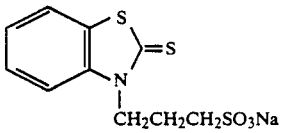

(I-5)

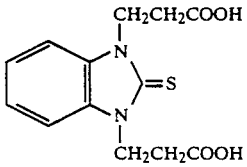

(I-6)

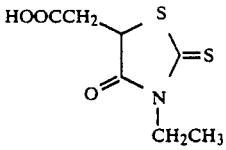

-continued
(I-7)
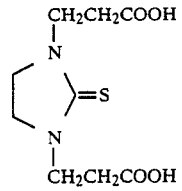
(I-8)
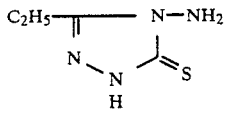
(I-9)
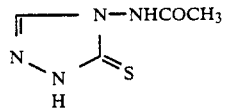
(I-10)
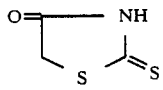
(II-1)
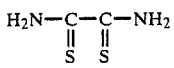
(II-2)
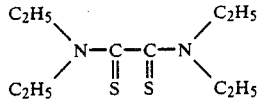
(II-3)
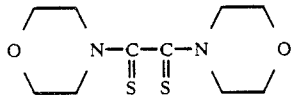
(II-4)
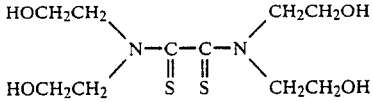
(II-5)
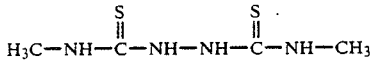
(II-6)
$H_2N-CSNHNHCS-NH_2$
(II-7)
$H_2N-CSNH(CH_2)_2NHCS-NH_2$
(II-8)
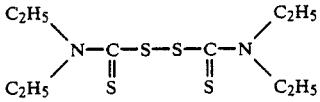
(II-9)
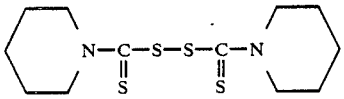
(II-10)
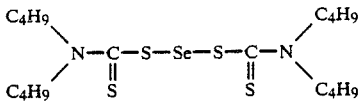
(II-11)
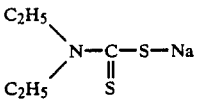
-continued
(II-12)
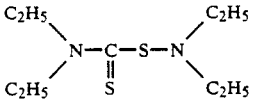
(II-13)
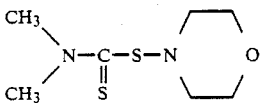
(II-14)
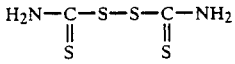
(II-15)
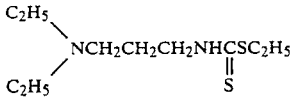
(II-16)
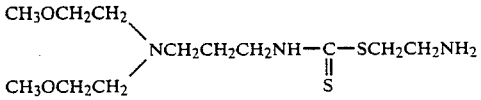
(II-17)
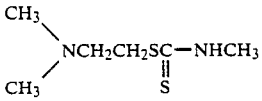
(II-18)
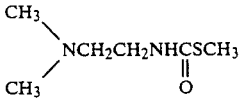
(II-19)
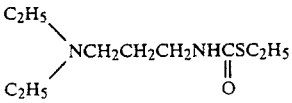
(II-20)
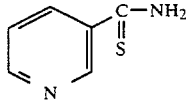
(II-21)
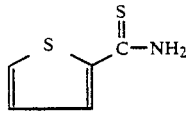
(II-22)
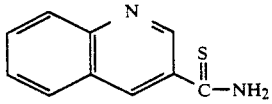
(II-23)
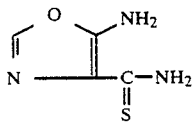
(II-24)
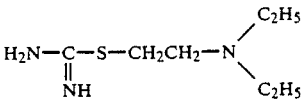
(II-25)
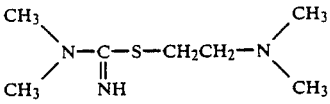

-continued
(II-26)
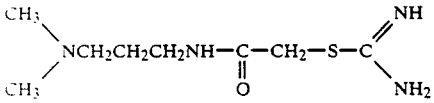
(II-27)
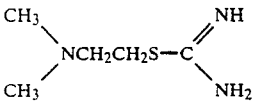
(III-1)
$H_2N-CH_2CH_2-SH$
(III-2)
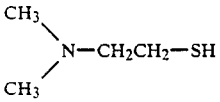
(III-3)
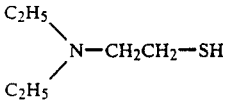
(III-4)
$HOOC-CH_2CH_2-SH$
(III-5)
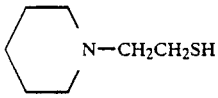
(III-6)
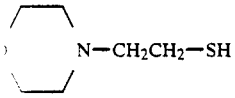
(III-7)
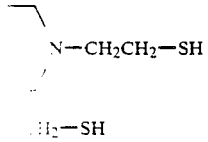
(III-8)
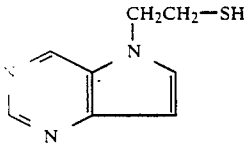
(III-9)
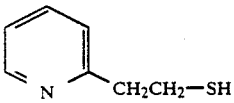
(III-10)
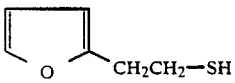
(III-11)
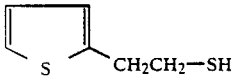
(III-12)
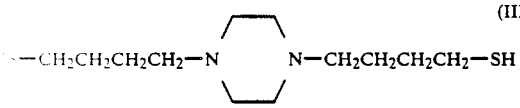
(III-13)
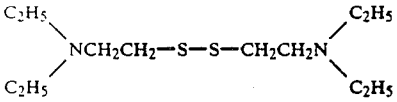
-continued
(III-14)
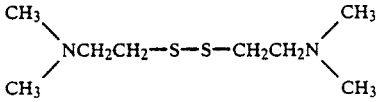
(III-15)
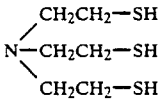
(IV-1)
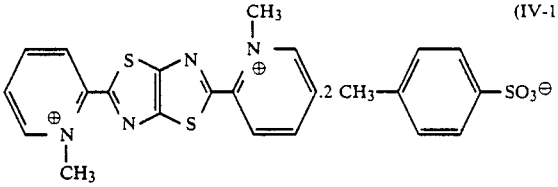
(IV-2)
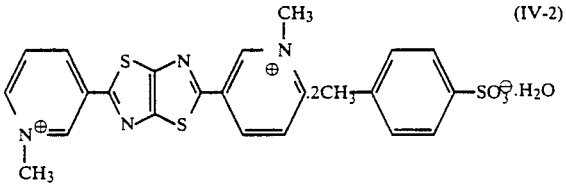
(IV-3)
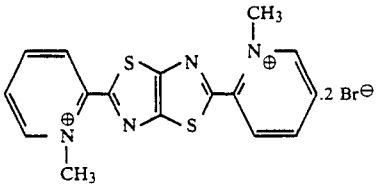
(V-1)
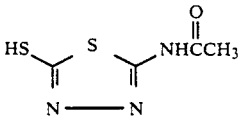
(V-2)
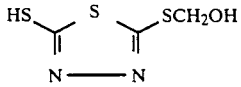
(V-3)
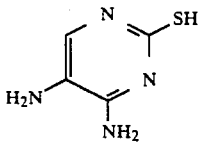
(V-4)
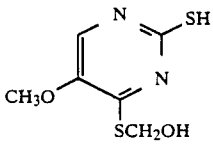
(V-5)
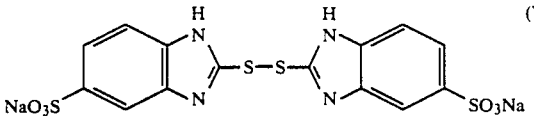
(V-6)
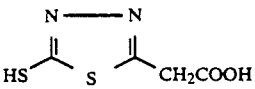

-continued
(V-7)
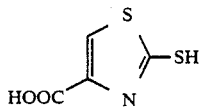
(V-8)
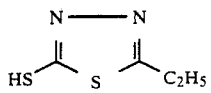
(V-9)
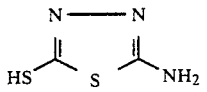
(V-10)
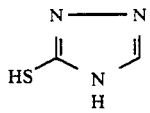
(V-11)
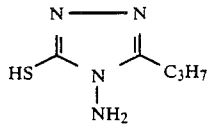
(V-12)
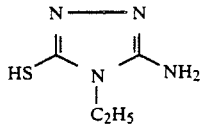
(V-13)
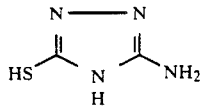
(V-14)
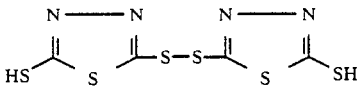
(V-15)
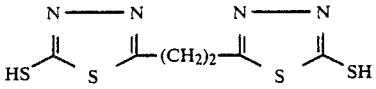
(V-16)
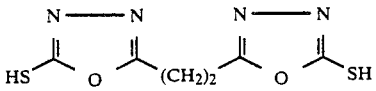
(V-17)
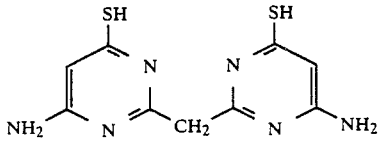
(V-18)
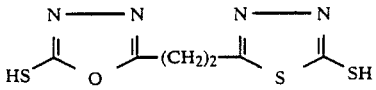
(V-19)
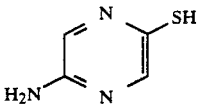
-continued
(V-20)
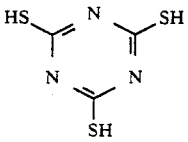
(V-21)
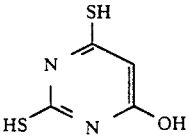
(V-22)
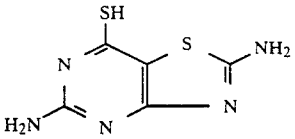
(V-23)
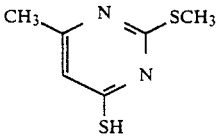
(V-24)
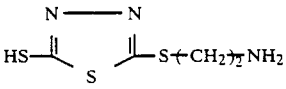
(V-25)
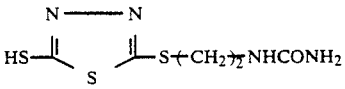
(V-26)
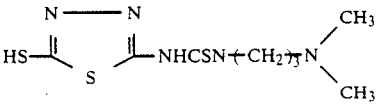
(V-27)
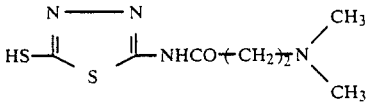
(V-28)
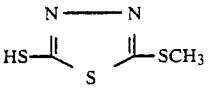
(V-29)
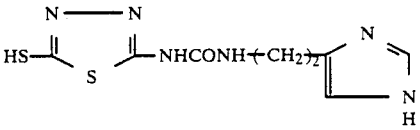
(V-30)
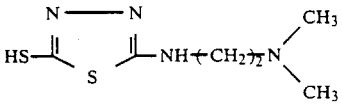
(VI-1)
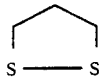
(VI-2)
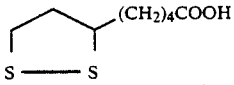

-continued
(VI-3)
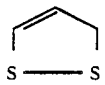
(VI-4)
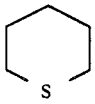
(VI-5)
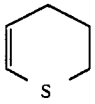
(VI-6)
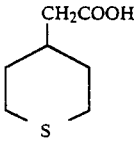
(VI-7)
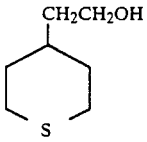
(VI-8)
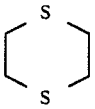
(VI-9)
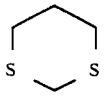
(VI-10)
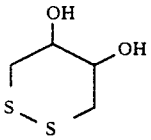
(VI-11)
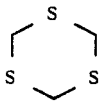
(VI-12)
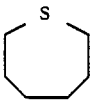
(VI-13)
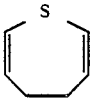
(VI-14)
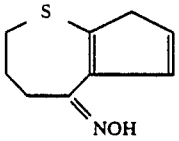
-continued
(VI-15)
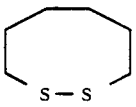
(VI-16)
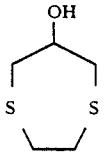
(VI-17)
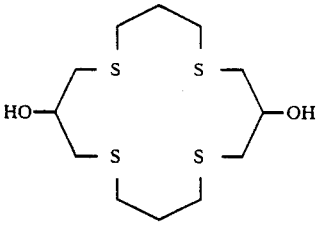
(VII-1)
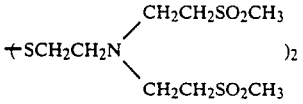
(VII-2)
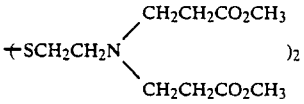
(VII-3)
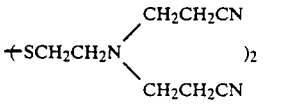
(VII-4)
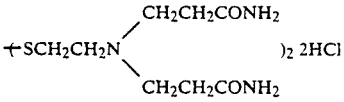
(VII-5)
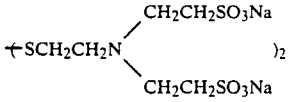
(VII-6)
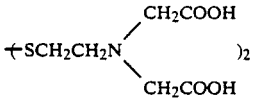
(VII-7)
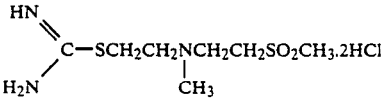
(VII-8)
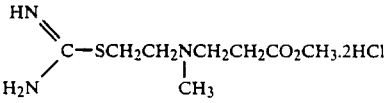
(VII-9)
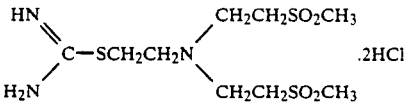
(VII-10)
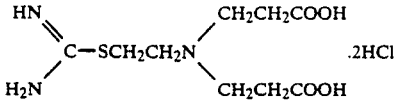

-continued
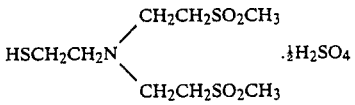
(VII-11)
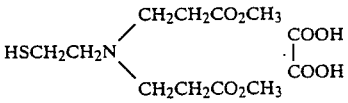
(VII-12)
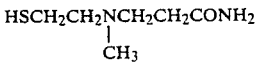
(VII-13)
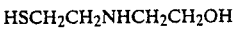
(VII-14)
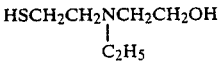
(VII-15)
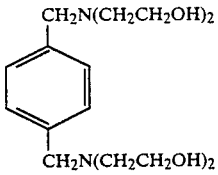
VIII-1
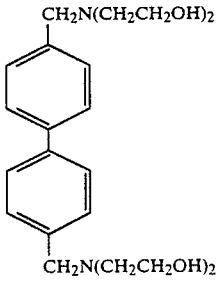
VIII-2
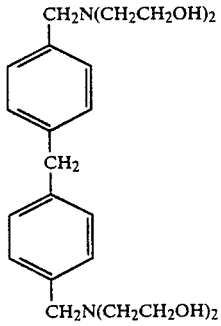
VIII-3
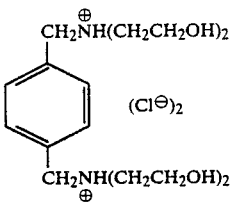
VIII-4
-continued
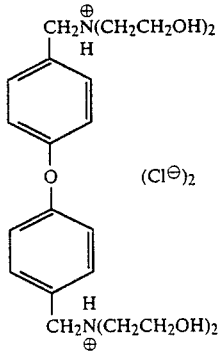
VIII-5
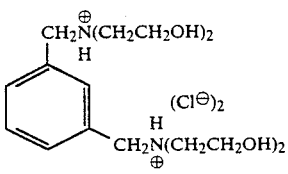
VIII-6
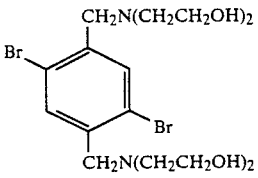
VIII-7
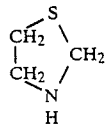
IX-1
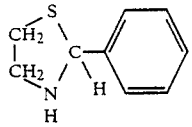
IX-2
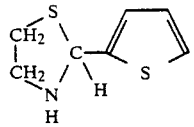
IX-3
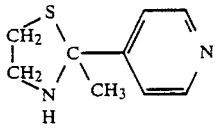
IX-4
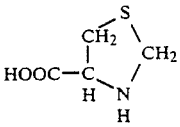
IX-5
Imidazole and the derivatives thereof
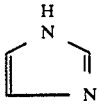
A'-1

-continued

A'-2

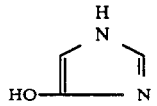

A'-3

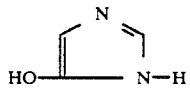

A'-4

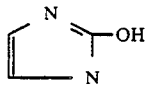

A'-5

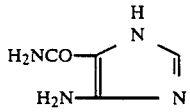

A'-6

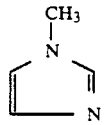

A'-7

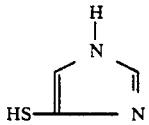

A'-8

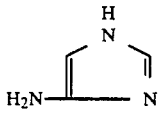

Besides the above-exemplified bleaching accelerators, for example, the following compounds may also similarly be used for.

The exemplified compounds given in Japanese Patent O.P.I. publication No. 62-123459, pp. 51–115, such as I-2, I-4 to 7, I-9 to 13, I-16 to 21, I-23, I-24, I-26, I-27, I-30 to 36, I-38, II-2 to 5, II-7 to 10, II-12 to 20, II-22 to 25, II-27, II-29 to 33, II-35, II-36, II-38 to 41, II-43, II-45 to 55, II-57 to 60, II-62 to 64, II-67 to 71, II-73 to 79, II-81 to 84, II-86 to 99, II-101, II-102, II-104 to 110, II-112 to 119, II-121 to 125, II-126, II-128 to 144, II-146, II-148 to 155, II-157, III-4, III-6 to 8, III-10, III-11, III-13, III-15 to 18, III-20, III-22, III-23, III-25, III-27, III-29 to 32, III-35, III-36, IV-3, IV-4, V-3 to 6, V-8 to 14, V-16 to 38, V-40 to 42, V-44 to 46, V-48 to 66, V-68 to 70, V-72 to 74, V-76 to 79, V-81, V-82, V-84 to 100, V-102 to 108, V-110, V-112, V-113, V-116 to 119, V-121 to 123, V-125 to 130, V-132 to 144,, V-146 to 162, V-164 to 174, V-176 to 184, VI-4, VI-7, VI-10, VI-12, VI-13, VI-16, VI-19, VI-21, VI-22, VI-25, VI-27 to 34, VI-36, VII-3, VII-6, VII-13, VII-19 and VII-20; those given in Japanese Patent O.P.I. Publication No. 63-17445, pp. 22–25, such as III-2 to 3, III-5 to 10, III-12 to 45, III-47 to 50, III-52 to 54, III-56 to 63 and III-65; and so forth.

They may be used independently or in combination and when they are generally used in an amount within the range of from about 0.01 to 100 g per liter of a bleaching solution or a bleach-fixer, an excellent result may be obtained. From the viewpoints of obtaining a bleach-acceleration effect and preventing a photographic light-sensitive material from staining, they should be used in an amount of, preferably, from 0.05 to 50 g per liter of the bleaching solution or the bleach-fixer used and, more preferably, from 0.05 to 15 g.

When such bleaching accelerator is added into a bleaching solution or a bleach-fixer, it may be added as it is and then dissolved therein. It is usual to add it after dissolving it in advance in water,. an alkaline solution, an organic acid or the like. If required, it may also be added therein after it is dissolved with an organic solvent such as methanol, ethanol, acetone or the like.

Such bleaching solutions may be used at a pH value of from 0.2 to 8.0, preferably, from not lower than 2.0 to not higher than 7.0 and, more preferably, from not lower than 4.0 to not higher than 6.5, and at a processing temperature of from 20° C. to 45° C. and, more preferably, from 25° C. to 42° C.

Such bleaching solution is usually used by adding a halide such as ammonium bromide therein.

The bleaching solutions each are also allowed to contain a pH buffer comprising a variety of salts, independently or in combination, such as boric acid, borax, sodium hydroxide, potassium hydroxide, sodium carbonate, potassium carbonate, sodium bicarbonate, potassium bicarbonate, acetic acid, sodium acetate, ammonium hydroxide and so forth. Further, the bleaching solutions are allowed to contain a variety of optical brightening agents, defoaming agents, surface active agents and antimolding agents.

Fixers and bleach-fixers should inevitably contain the so-called fixing agents.

The fixing agents include a compound capable of producing a water-soluble complex salt upon reaction with a silver halide. The compounds include, for example, thiosulfates such as potassium thiosulfate, sodium thiosulfate and ammonium thiosulfate; thiocyanates such as potassium thiocyanate, sodium thiocyanate and ammonium thiocyanate; thiourea; thioether; and so forth.

Besides the above-given fixing agents, the fixers and the bleach-fixers are also allowed to contain, independently or in combination, sulfites such as ammonium sulfite, potassium sulfite, ammonium bisulfite, potassium bisulfite, sodium bisulfite, ammonium metabisulfite, potassium metabisulfite, sodium metabisulfite and so forth, and pH buffers comprising a variety of salts such as boric acid, borax, sodium hydroxide, potassium hydroxide, sodium carbonate, potassium carbonate, sodium bucarbonate, potassium bicarbonate, acetic acid, sodium acetate, ammonium hydroxide and so forth.

Those fixers and bleach-fixers are desired to contain a large quantity of alkali halides or ammonium halides such as potassium bromide, sodium bromide, sodium chloride, ammonium bromide and so forth as a rehalogenizing agent. Those fixers and bleach-fixers are also allowed to contain selectively pH buffers such as borates, oxalates, acetates, carnonates, phosphates and so forth, and, alkylamines, polyethylene oxides and so forth which are well-known as the additives to fixers and bleach-fixers.

The above-mentioned fixing agents are used in an amount of not less than 0.1 mol per liter of a processing solution used. From the viewpoint of the achievement of the objects of the invention, they are used in an amount within the range of, preferably, from 0.6 mol to 4 mol, more preferably, from 0.9 mol to 3.0 mol and, further preferably, from 1.1 mol to 2.0 mol.

If required, for the purpose of more activating a bleaching solution or a bleach-fixer, air or oxygen may be blown into a processing bath or a processing replenisher reservoir, or an appropriate oxidizer such as hydrogen peroxide, a bromate, a persulfate and so forth may be added.

Fixers and bleach-fixers each may be replenished in an amount of, preferably, not more than 800 ml per sq. meter of a light-sensitive material to be fixed, more preferably, from 20 ml to 650 ml and, further preferably, from 30 ml to 400 ml.

Fixers and bleach-fixers each should preferably contain an iodide such as ammonium iodide, potassium iodide, sodium iodide, lithium iodide or the like in an amount of from 0.1 to 10 g/liter, more preferably, from 0.3 to 5 g/liter, further preferably, from 0.5 to 3 g/liter and, most preferably, from 0.8 to 2 g/liter.

A processing solution having a fixing capability, such as a fixer or bleach-fixer, should preferably contain a compound represented by the following Formula FA or FB. When using a fixer or bleach-fixer containing the compound, there is an additional effect that very little sludge is produced in occasionally processing a small quantity of light-sensitive material in the course of a long period of time.

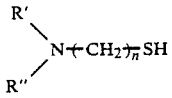

Formula FA wherein R′ and R each represent a hydrogen atom, an alkyl group, an aryl group, an aralkyl group or a nitrogen-containing heterocyclic ring; and n′ is an integer of 2 or 3.

The compounds represented by the above-given Formula FA will be typically exemplified.

| No. | R′ | R″ | n′ |
|---|---|---|---|
| FA-1 | iso-$C_3H_7$— | H | 2 |
| FA-2 | n-$C_4H_9$— | H | 2 |
| FA-3 | iso-$C_4H_9$— | H | 2 |
| FA-4 | sec-$C_4H_9$— | H | 2 |
| FA-5 | ter-$C_4H_9$— | H | 2 |
| FA-6 | CH=$CHCH_2$— | H | 2 |
| FA-7 | n-$C_6H_{13}$— | H | 2 |
| FA-8 | n-$C_8H_{17}$— | H | 2 |
| FA-9 | n-$C_{10}H_{21}$— | H | 2 |
| FA-10 | 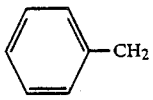 | H | 2 |
| FA-11 | 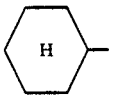 | H | 2 |
| FA-12 | $C_2H_5$— | $C_2H_5$— | 2 |
| FA-13 | n-$C_3H_7$— | n-$C_3H_7$— | 2 |
| FA-14 | iso-$C_3H_7$— | iso-$C_3H_7$— | 2 |
| FA-15 | n-$C_4H_9$— | n-$C_4H_9$— | 2 |
| FA-16 | iso-$C_4H_9$— | iso-$C_4H_9$— | 2 |
| FA-17 | sec-$C_4H_9$— | sec-$C_4H_9$— | 2 |
| FA-18 | n-$C_5H_{11}$— | n-$C_5H_{11}$— | 2 |
| FA-19 | iso-$C_5H_{11}$— | iso-$C_5H_{11}$— | 2 |
| FA-20 | $CH_2$=CH—$CH_2$— | $CH_2$=$CHCH_2$— | 2 |
| FA-21 | $CH_3$— | $CH_3$— | 2 |
| FA-22 | $HOCH_2CH_2$— | H— | 2 |
| FA-23 | $HOCH_2CH_2$— | $CH_3$— | 2 |

-continued

| No. | R′ | R″ | n′ |
|---|---|---|---|
| FA-24 | 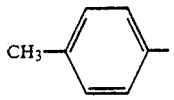 | H— | 2 |
| FA-25 | 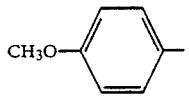 | H— | 2 |
| FA-26 | 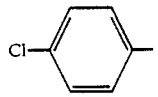 | H— | 2 |
| FA-27 | $C_2H_5$— | $CH_3$— | 2 |
| FA-28 | $C_2H_5$— | $C_3H_7$— | 2 |
| FA-29 | H— | H— | 2 |
| FA-30 | $CH_2$=CH—$CH_2$— | $C_2H_5$— | 2 |
| FA-31 | 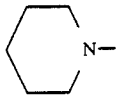 | | 2 |
| FA-32 | 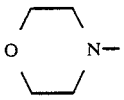 | | 2 |
| FA-33 | 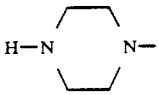 | | 2 |
| FA-34 | 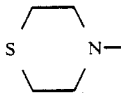 | | 2 |
| FA-35 | 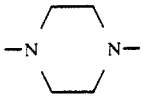 | | 2 |
| FA-36 | 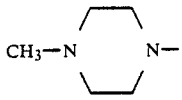 | | 2 |
| FA-37 | $C_2H_2$— | $C_2H_5$— | 3 |
| FA-38 | $HSCH_2CH_2$— | $HSCH_2CH_2$— | 2 |
| FA-39 | $HSCH_2CH_2$— | HOOC—$CH_2$— | 2 |

Those compounds represented by Formula FA may be synthesized in ordinary methods such as those described in, for example, U.S. Pat. Nos. 3,335,161 and 3,260,718.

A series of Compounds FB

FB-1 Thiourea
FB-2 Ammonium iodide
FB-3 Potassium iodide
FB-4 Ammonium thiocyanate
FB-5 Potassium thiocyanate
FB-6 Sodium thiocyanate
FB-7 Thiocyanocatechol Both of the compounds represented by the foregoing Formula FA and the series of Compounds FB may be used independently or in combination. The preferable examples of the combinations thereof include the combinations each of thiourea, ammonium thiocyanate and ammonium iodide; thiourea and ammonium thiocyanate; FA-12 and thiourea; FA-12 and ammonium thiocyanate; FA-12 and ammonium iodide; FA-12 and FA-32; FA-12 and FA-38; and so forth.

When the compounds represented by Formula FA and the series of the compounds FB are each added in an amount within the range of from 0.1 to 200 g per liter of a processing solution, a good result may be obtained. In particular, they are added in an amount within the range of, preferably, from 0.2 to 100 g and, more preferably, from 0.5 to 50 g.

In the invention, when using a processing solution having a fixing capability, such as a fixer or a bleach-fixer, the processing time thereof is not longer than 3 minutes 45 seconds in total. Such total processing time should be within the range of, preferably, from 20 seconds to 3 minutes 20 seconds, more preferably, from 40 seconds to 3 minutes and, further preferably, from 60 seconds to 2 minutes 40 seconds.

When using the same, the bleaching time should be within the range of, preferably, not longer than 1 minute 30 seconds, more preferably, from 10 to 70 seconds and, further preferably, from 20 to 55 seconds. The processing time of the processing solution having a fixing capability should be within the range of, preferably, not longer than 3 minutes 10 seconds, more preferably, from 10 seconds to 2 minutes 40 seconds and, further preferably, from 20 seconds to 2 minutes 10 seconds.

The treating with the solution having fixing capability is preferably performed at a temperature from 20° C. to 45° C. and, more preferably, from 25° C. to 42° C.

It is also preferable to give a forced liquid-agitation to such fixer and bleach-fixer. The agitation is also preferable from the viewpoint of giving a rapid processing aptitude.

The word, 'a forced agitation' stated herein, does not mean the so-called usual diffusion/transfer of a liquid, but means that a liquid is forcibly agitated by additionally providing a agitating means.

Such forced agitating means include, for example, the following means:

1. A high-pressure spray means or a blowing means,
2. An air-bubbling means,
3. A supersonic oscillating means, and
4. A vibration means.

When using a stabilizer for improving an image preservability, a pH value thereof should be within the range of, preferably, from 4.0 to 9.0, more preferably, from 4.5 to 9.0 and, further preferably, from 5.0 to 8.5.

As for the pH controllers which may be contained in a stabilizer, any of alkalizers or acidifyers having been generally known may be used for.

Such stabilizers may be added with organic acid salts such as those of citric acid, acetic acid, succinic acid, oxalic acid, benzoic acid or the like; pH controllers such as phosphates, borates, sulfates and so forth; surface active agents; antiseptics; metal salts such as those of Bi, Mg, Zn, Ni, Al, Sn, Ti, Zr or the like; and so forth. These compounds may be added in any amount, provided that the pH values of a stabilizing bath may be necessarily maintained and that a color photographic image may be kept stable in preservation and a precipitation may be inhibited from producing. These compounds may also be used in any combinations.

Antimolds preferably applicable to each stabilizer include, for example, a hydroxybenzoate compound, a phenol type compound, a thiazole type compound, a pyridine type compound, a guanidine type compound, a carbamate type compound, a morpholine type compound, a quaternary phosphonium type compound, an ammonium type compound, a urea type compound, an isooxazole type compound, a propanolamine type compound, a sulfamide type compound, an aminoic acid type compound, an active halogen-releasable compound and a benzotriazole type compound.

Among such antimolds, the preferable ones include, for example, a phenol type compound, a thiazole type compound, a pyridine type compound, a guanidine type compound, a quaternary ammonium type compound, an active halogen-releasable compound and a benzotriazole type compound. The antimolds particularly preferable for liquid preservability include, for example, a phenol type compound, a thiazole type compound, an active halogen-releasable compound and a benzotriazole type compound.

Such antimold is added into a stabilizer used in place of water-washing in an amount within the range of, preferably, from 0.001 to 50 g per liter of a stabilizer solution used and, more preferably, from 0.005 to 10 g.

From the solutions containing soluble silver salts, such as stabilizers, fixers. bleach-fixers and so forth, silver may be recovered in a variety of silver recovering methods. For example, the effectively applicable silver recovery methods include an electrolysis methods such as that described in French Patent No. 2,299,667; a precipitation method such as those described in Japanese Patent O.P.I. Publication No. 52-73037(1977) and West German Patent No. 2,331,220; an ion-exchange method described in Japanese Patent O.P.I. Publication No. 51-17114(1976) and West German Patent No. 2,548,237; a transmetallation methods such as that described in British Patent No. 1,353,805; and so forth.

Silver may be recovered through an in-line system from a tank processing solution tank. Or, the above-mentioned soluble silver salts are recovered in the above-mentioned method from the overflow of a processing solution, silver may then be recovered and the residual solution may be discarded as a waste solution. Further, the residual solution may be added with a regenerating agent so as to reuse as a replenisher or a processing solution. It is particularly preferable to recover silver after mixing a stabilizer into a fixer or a bleach-fixer.

In this case, it is also allowed to use a process of bringing a stabilizer into contact with an ion-exchange resin, an electrodialysis process and a reverse permeation process to which Japanese Patent O.P.I. Publication No. 61-28949(1986) may be referred, and so forth.

The stabilizer is to be replenished in an amount, preferably, one to 80 times as much as an amount of solution brought from the preceding bath together with a color photographic light-sensitive material for picture-taking use which is to be processed and, more preferably, 2 to 60 times as much. In a stabilizer solution, a concentration of the components brought from the preceding bath, i.e., a bleach-fixer or fixer, into the stabilizer solution should be, preferably, not more than 1/500 in the final tank of the stabilizing tanks and, more preferably, not more than 1/1000. From the viewpoints of diminishing environmental pollutions and keeping the preservability of the stabilizing solution, it is desired to constitute the stabilizing tanks so that the foregoing concentration may be, preferably, from 1/500 to 1/100000 and, more preferably, from 1/2000 to 1/50000.

Such stabilizing tank may be consisted of a plurality of tanks and they should preferably be not less than two tanks but not more than six tanks.

Particularly from the viewpoints of diminishing environmental pollutions and improving an image preservability. it is preferable that the stabilizing tanks should be consisted of not less than two tanks but not more than six tanks and, at the same time, a counter-current system should be provided to a series of the tanks, that is, a system in which a stabilizer is supplied to the consecutive bath and an overflow is supplied from the preceding bath. The number of the tanks should be, preferably, two or three tanks and, more preferably, two tanks.

An amount brought from the preceding bath depends on the types of light-sensitive materials processed, the conveyance speeds and systems of automatic processors used, the systems of squeezing the surface of a light-sensitive material processed, and so forth. In the case of a color roll film, an amount brought therefrom is ordinarily from 50 to 150 ml/m$^2$, and a replenishing amount for stabilizer should be within the range of, preferably, from 50 ml/m$^2$ to 4.0 liters/m$^2$ and, more preferably, from 200 to 1500 ml/m$^2$.

In the processes with a stabilizer, a processing temperature should be within the range of, preferably, from 15 to 60° C. and, more preferably, from 20 to 45° C.

In the invention, a silver halide color photographic light-sensitive material comprises at least one silver halide emulsion layer provided onto at least one side of the support. Such light-sensitive material may be either a monocolor photographic light-sensitive material or a multicolor photographic light-sensitive material.

In the case of a full-color light-sensitive material, the support thereof is provided thereon with a silver halide emulsion layer comprising at least one each of a red light-sensitive emulsion layer, a green light-sensitive emulsion layer, and a blue light-sensitive emulsion layer. It is allowed to arrange the red light-sensitive layer, the green light-sensitive layer and the blue light-sensitive layer in order from the support. It is also allowed to arrange them in other order. However, the former layer arrangement is preferred. Each of such light-sensitive layers may be comprised of one or more layers and, preferably, two or more layers. A non-light-sensitive hydrophilic colloidal interlayer may be arranged to some or the whole interface between the light-sensitive silver halide emulsion layers each having a different color-sensitivity, or between the light-sensitive silver halide emulsion layers each having the same color-sensitivity, but a different light-sensitivity. Further, a non-light-sensitive hydrophilic colloidal protective layer may also provided to serve as the uppermost layer.

The emulsion layers of a color photographic light-sensitive material are added with a dye-forming coupler capable of forming a dye, in an ordinary color developing process, upon coupling reaction with the oxidized product of an aromatic primary amine developing agent such as a p-phenylenediamine derivative, an aminophenol derivative or the like.

In general, such dye-forming couplers are selectively used for each emulsion layer so that a spectral absorption of the dye formed by a coupler may be in correspondence with a spectral sensitivity of an emulsion. It is, therefore, usual to apply a yellow dye-forming coupler to a blue-sensitive emulsion layer, a magenta dye-forming coupler to a green-sensitive emulsion layer and a cyan dye-forming coupler to a red-sensitive emulsion layer, respectively. And yet any other selections are also allowable.

In the invention, it is preferable to apply a light-sensitive material with a benzoyl type coupler which serves as a yellow coupler. In particular, the yellow couplers represented by the following Formula Y-1 are preferably used.

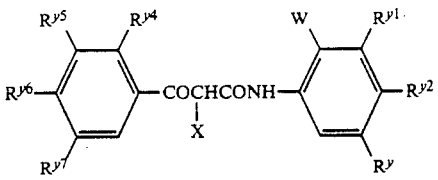

Formula Y-1 wherein $R^{y1}$, $R^{y2}$ and $R^{y3}$ may be the same with or the different from each other and each represent a hydrogen atom; a halogen atom such as an atom of fluorine, chlorine, bromine of the like; an alkyl group such as a group of methyl, ethyl, allyl, dodecyl or the like; an aryl group such as a group of phenyl, naphthyl or the like; an alkoxy group such as a group of methoxy, ethoxy, dodecyloxy or the like; an acylamino group such as a group of acetoamide, α-(p-dodecyloxyphenoxy)butanamide or the like; a carbamoyl group such as a group of carbamoyl, N,N-dimethylcarbamoyl, N-δ-(2,4-di-tert-amylphenoxy)butylcarbamoyl or the like; an alkoxycarbonyl group such as a group of ethoxycarbonyl, dodecyloxycarbonyl, α-(dodecyloxycarbonyl)ethoxycarbonyl or the like; a sulfonamido group such as a group of methanesulfonamido, p-dodecyloxybenzenesulfonamido, N-benzyldodecanesulfonamido or the like; or a sulfamoyl group such as a group of sulfamoyl, N-methylsulfamoyl, N-δ-(2,4-di-tert-amylphenoxy)-butylsulfamoyl, N,N-diethylsulfamoyl or the like:

$R^{y4}$, $R^{y5}$, $R^{y6}$ and $R^{y7}$ may be the same with or the different from each other, and each represent a hydrogen atom; an alkyl group such as a group of methyl, ethyl, tert-butyl or the like; an alkoxy group such as a group of methoxy, ethoxy, propoxy, octoxy or the like; an aryloxy group such as a group of phenoxymethylphenoxy or the like; an acylamino group such as a group of acetamido, α-(2,4-di-tertamylphenoxy)butanamide or the like; or a sulfonamido group such as a group of methanesulfonamido, N-benzyldodecanesulfonamido. N-benzyldodecanesulfonamido, or the like:

W represents a halogen atom such as an atom of fluorine, chlorine, bromine of the like; an alkyl group such as a group of methyl, ethyl, tert-butyl or the like; an alkoxy group such as a group of methoxy, ethoxy, propoxy, octoxy or the like; an aryloxy group such as a group of phenoxy, methylphenoxy or the like; or a dialkylamino group such as a group of dimethylamino, N-butyl-N-octylamino or the like:

X represents a hydrogen atom; or a group capable of being split off which may preferably be represented by the following Formula Y-2.

Formula Y-2

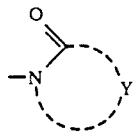

wherein Y represents a group of non-metal atoms necessary to complete a 5- or 6-membered ring. Such cyclic compounds thus completed include, for example, each derivative of 2,5-dioxo-imidazoline, 2,5-pyrrolidinedione, 1,3-isoindoledione, 2,3,5-trioxo-imidazolidine, 2,5-dioxotriazolidine, 2,4-oxazolidinedione, 2,4-thiazolidinedione, 2(1H)-pyridone, 2(1H)-pyrimidone, 2(1H)-pyrazone, 5(1H)-imidazolone, 5(1H)-triazolone, 2(1H)-pyrimidone, 2-pyrazolone(5), 2-isothiazolone(5), 2(1H)-quinaoxazolone, 4(3H)-pyrimidone,. 2-benzoxazolone, 4-isooxazolone(5), 3-phlorone(2), 4-imidazolone(2), 3-pyrazolone, 2-tetrazolone(5), 3-tetrazolone(5) and so forth.

The typical yellow couplers represented by Formula Y-1 will be exemplified below.

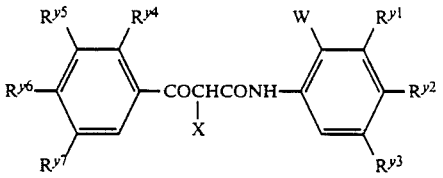

| Exemplified compound No. | $R^{y1}$ | $R^{y2}$ | $R^{y3}$ | $R^{y4}$ | $R^{y5}$ | $R^{y6}$ | $R^{y7}$ | W | X |
|---|---|---|---|---|---|---|---|---|---|
| Y-1 | —H | —H | (7) | —H | —H | (4) | —H | (1) | (16) |
| Y-2 | —H | —H | (7) | —H | —H | (4) | —H | (1) | (17) |
| Y-3 | —H | —H | (8) | —H | —H | —H | —H | (1) | (18) |
| Y-4 | —H | —H | (8) | —H | —H | —H | —H | (4) | (19) |
| Y-5 | —H | —H | (6) | (2) | —H | —H | —H | (4) | (20) |
| Y-6 | —H | —H | (9) | —H | —H | (4) | —H | (1) | (21) |
| Y-7 | —H | —H | (11) | —H | (10) | (4) | —H | (4) | (22) |
| Y-8 | —H | —H | —H | —H | —H | —H | (7) | (4) | (23) |
| Y-9 | —H | —H | (12) | —H | —H | (4) | —H | (1) | (24) |
| Y-10 | —H | —H | (13) | —H | —H | —H | —H | (1) | (25) |
| Y-11 | —H | —H | (14) | —H | —H | (4) | —H | (1) | (26) |
| Y-12 | —H | —H | (15) | —H | —H | (4) | —H | (1) | (27) |
| Y-13 | —H | —H | —H | —H | —H | (4) | —H | (4) | —H |
| Y-14 | —H | —H | —H | —H | —H | (5) | —H | (1) | (28) |
| Y-15 | —H | —H | (6) | —H | —H | (4) | —H | (1) | (29) |

(1) —Cl (2) —$CH_3$
(3) —$C_{18}H_{37}$ (4) —$OCH_3$
(5) —$NHCOC_{17}H_{35}$ (6) —$COOC_{12}H_{25}$ (7)

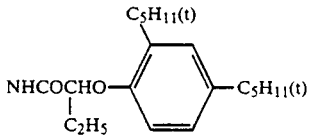

(8) —$COOCH(CH_3)COOC_{12}H_{25}$ (9) —$NHCOCH(CH_3)CH_2SO_2C_{12}H_{25}$

-continued

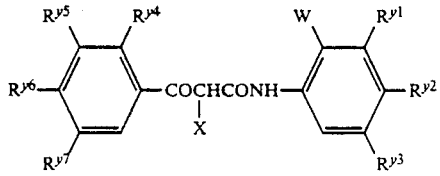

(10)

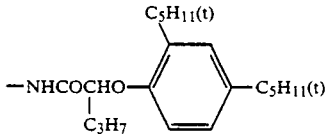

(11)

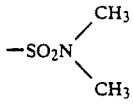

(12)

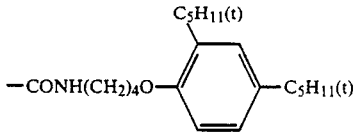

(13) —$COOCH(CH_3)CH_2SO_2C_{12}H_{25}$ (14)

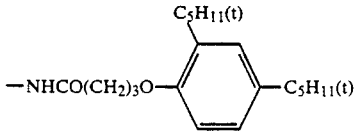

(15)

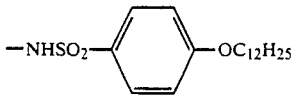

(16)

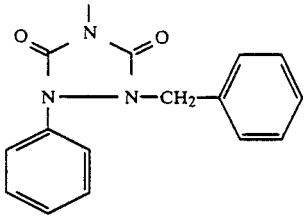

(17)

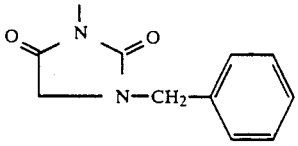

(18)

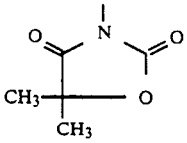

(19)

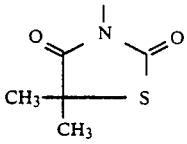

-continued

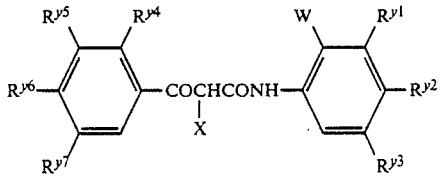

(20)

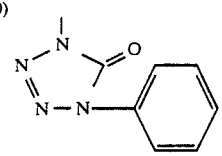

(21)

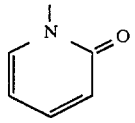

(22)

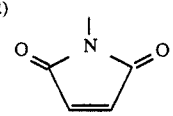

(23)

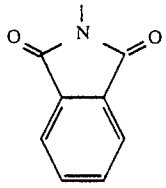

(24)

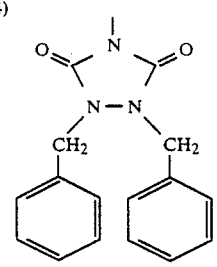

(25)

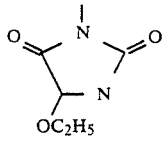

(26)

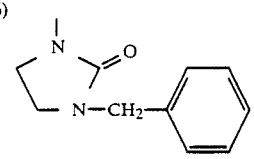

(27)

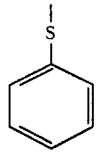

(28)

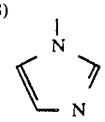

(29)

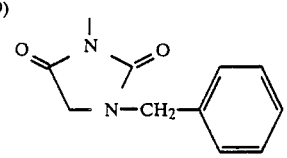

In the invention, it is preferable to use the pyrazolotriazole type magenta couplers represented by the following Formulas M-1 and M-2, to serve as the couplers for forming a magenta-dye image.

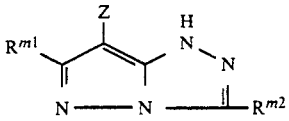

Formula M-1

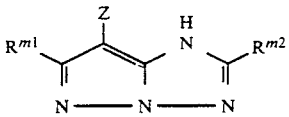

Formula M-2

In the above-given Formulas M-1 and M-2, $R^{m1}$ and $R^{m2}$ each represent an alkyl group, a cycloalkyl group, an aryl group or a heterocyclic group. Each of these groups is also allowed to bond together through oxygen atom, nitrogen atom or sulfur atom. Each of these groups is further allowed to bond together through any of the following linkage groups, namely, an acylamino group, a carbamoyl group, a sulfonamido group, a sulfamoylcarbonyl group, a carbonyloxy group, an oxycarbonyl group, a ureido group, a thioureido group, a thioamido group, a sulfon group, and a sulfonyloxy group.

The alkyl groups represented by $R^{m1}$ and $R^{m2}$ are, preferably, the straight-chained or branched alkyl groups each having 1 to 20 carbon atoms. Further, these groups include those having such a substituent as a halogen atom, a nitro group, a cyano group, an alkoxy group, an aryloxy group, an amino group, an acylamino group, a carbamoyl group, a sulfonamido group, a sulfamoyl group, an imido group, an alkylthio group, an arylthio group, an aryl group, an alkoxycarbonyl group and an acyl group.

The cycloalkyl groups include, for example, a cyclopropyl group, a cyclohexyl group, and so forth, and those having the same substituents as given to the above-mentioned alkyl groups.

The aryl groups include, for example, a phenyl group, a naphthyl group and so forth, and those having the same substituents as given to the above-mentioned alkyl groups.

The heterocyclic groups include 5- or 6-membered heterocyclic groups having at least either one of nitrogen atom. oxygen atom and sulfur atom, and they also include either of the aromatic or non-aromatic. The examples thereof include a pyridyl group, a quinolyl group, a pyrrolyl group, a morpholyl group, a furanyl group, a tetrahydrofuranyl group, a pyrazolyl group, a triazolyl group, a tetrazolyl group, a thiazolyl group, an oxazolyl group, an imidazolyl group, a thiadiazolyl group and so forth. These groups also include those having the same substituents given to the above-mentioned alkyl groups.

The magenta dye-forming couplers preferably applicable to the invention will be exemplified below.

M-1

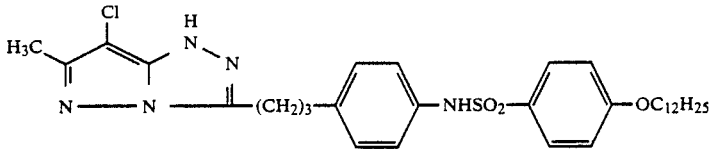

-continued
M-2
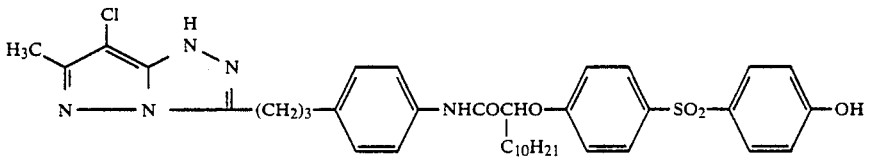
M-3
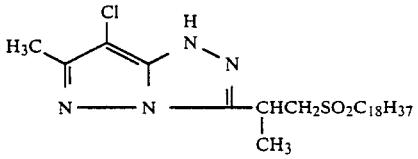
M-4
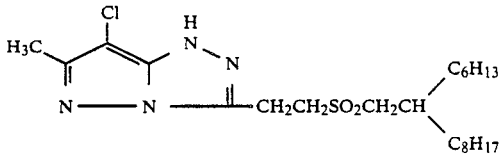
M-5
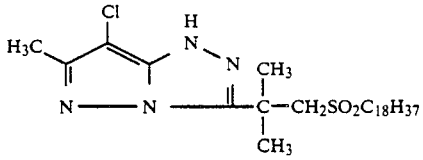
M-6
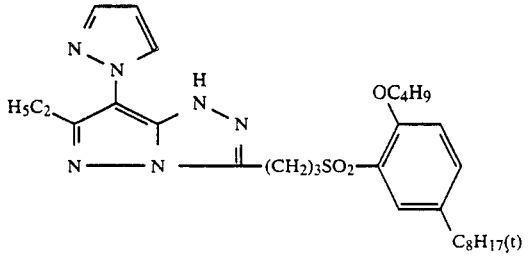
M-7
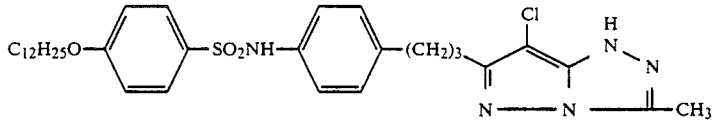
M-8
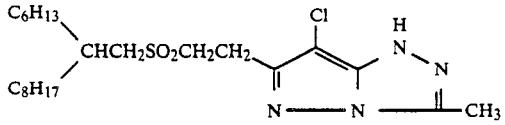
M-9
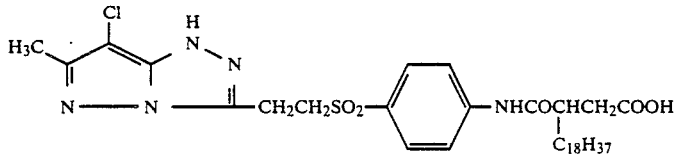
M-10
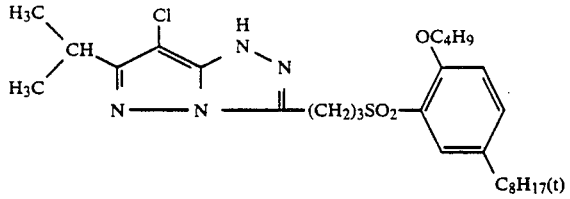

-continued
M-11
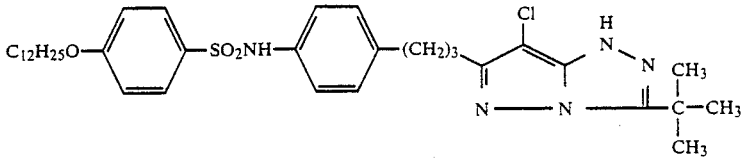
M-12
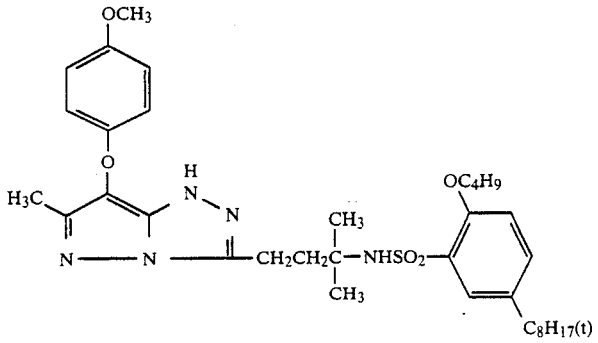
M-13
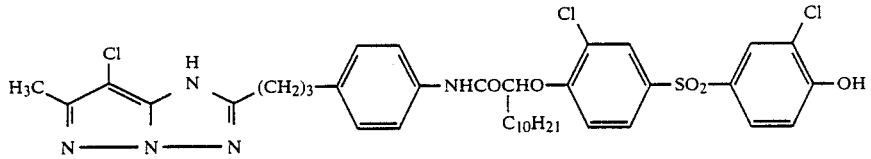
M-14
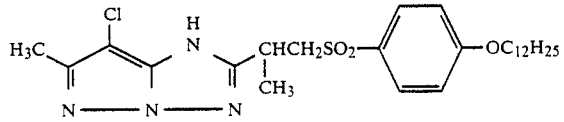
M-15
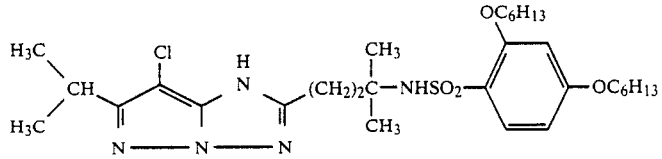
M-16
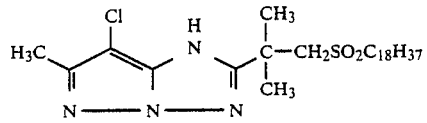
M-17
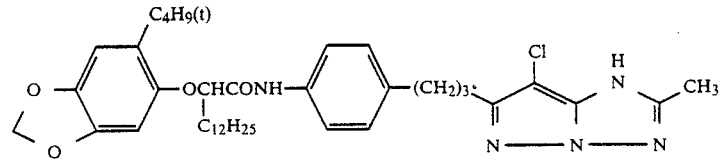
M-18
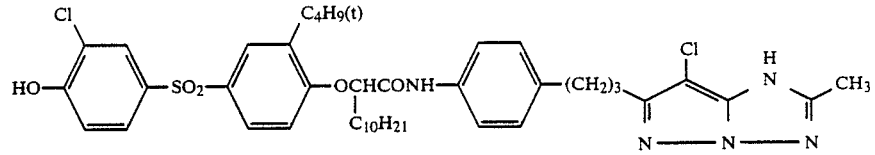

-continued

M-19

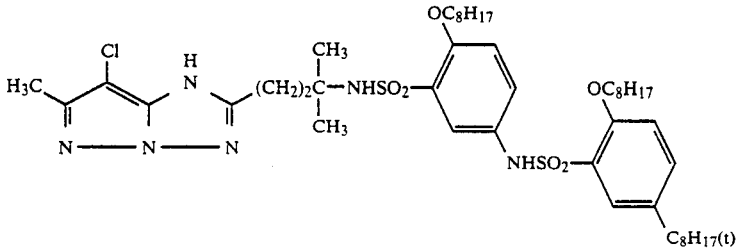

Any kinds of couplers may be used for cyan couplers. For example, a phenol or naphthol type cyan couplers may generally be used. The cyan couplers which may preferably be used given in, for example, U.S. Pat. No. 3,893,044, Japanese Patent O.P.I. Publication No. 58-98731/(1983), and so forth.

Any kinds of ordinary types of silver halide emulsions can be applied to light-sensitive materials used in the invention.

Such emulsions may be chemically sensitized in a usual method, and they may also be optically sensitized to any desired spectral wavelength region by making use of a sensitizing dye.

Such silver halide emulsions may be added with an antifoggant, a stabilizer, and so forth. Gelatin may advantageously be used as the binders for such emulsions.

Any emulsion layers and other hydrophilic colloidal layers may be hardened, and they are allowed to contain a plasticizer and the dispersion, i.e., the latex, of a water-soluble or hardly-soluble synthetic polymer.

As described above, such emulsions are usually added with a coupler and, besides, a colored coupler having a color-correction effect, a competing coupler and a compound capable of releasing a photographically useful fragment through the coupling reactiona with the oxidized product of a developing agent. Such gragments include, for example, a development accelerator, a developing agent, a silver halide solvent, a color controlling agent, a hardener, a fogging agent, an anti-fogging agent, a chemical sensitizer, a spectral sensitizer and a desensitizer.

The light-sensitive materials may be provided with an auxiliary layer such as a filter layer, an antihalation layer, an anti-irradiation layer and so forth. The above-given layers and/or the emulsion layers are also allowed to contain a dye which may be either flowed out of the light-sensitive material or bleached, in the course of processing.

The light-sensitive materials may further be added with a matting agent, a lubricant, an image stabilizer, a surface active agent, an anti-color-foggant, a development accelerator, a development decelerator and a bleaching accelerator.

The supports of such light-sensitive materials include, for example, a sheet of paper laminated with polyethylene or the like, a polyethyleneterephthalate film, a sheet of baryta paper, a cellulose triacetate film and so forth may be used.

EXAMPLES

Now, referring the the following examples, this invention will be further detailed. It is, however, a matter of course that the invention shall not be limited thereto.

In the following examples, every amount of the substances added to silver halide photographic light-sensitive materials is expressed as per weight unit of gram and area unit of square meter, unless otherwise expresslly stated.

Example-1

Sample-1 of a multilayered color photographic material was prepared by arranging onto a triacetyl cellulose film support with the layers having the following compositions in order from the support side.

| Sample-1 | |
|---|---|
| Layer 1: An antihalation layer, HC-1 | |
| Black colloidal silver | 0.20 |
| UV absorbent, UV-1 | 0.20 |
| Colored coupler, CC-1 | 0.05 |
| Colored coupler, CM-2 | 0.05 |
| High boiling solvent, Oil-1 | 0.20 |
| Gelatin | 1.5 |
| Layer 2: An interlayer, IL-1 | |
| UV absorbent, UV-1 | 0.01 |
| High boiling solvent, Oil-1 | 0.01 |
| Gelatin | 1.2 |
| Layer 3: A low-speed red-sensitive emulsion layer, RL | |
| Silver iodobromide emulsion, Em-1 | 0.7 |
| Silver iodobromide emulsion, Em-2 | 0.4 |
| Sensitizing dye, S-1 | $2.5 \times 10^{-4}$ mol/mol Ag |
| Sensitizing dye, S-2 | $2.5 \times 10^{-4}$ mol/mol Ag |
| Sensitizing dye, S-3 | $0.5 \times 10^{-4}$ mol/mol Ag |
| Cyan coupler, C-4 | 1.2 |
| Cyan coupler, C-2 | 0.06 |
| Colored cyan coupler, CC-1 | 0.05 |
| DIR compound, D-1 | 0.002 |
| High boiling solvent, Oil-1 | 0.5 |
| Gelatin | 1.2 |
| Layer 4: A high-speed red-sensitive emulsion layer, RH | |
| Silver iodobromide emulsion, Em-3 | 1.3 |
| Sensitizing dye, S-1 | $2.0 \times 10^{-4}$ mol/mol Ag |
| Sensitizing dye, S-2 | $2.0 \times 10^{-4}$ mol/mol Ag |
| Sensitizing dye, S-3 | $0.1 \times 10^{-4}$ mol/mol Ag |
| Cyan coupler, C-1 | 0.15 |
| Cyan coupler, C-2 | 0.018 |
| Cyan coupler, C-3 | 1.15 |
| Colored cyan coupler, CC-1 | 0.015 |
| DIR compound, D-2 | 0.05 |
| High boiling solvent, Oil-1 | 0.5 |
| Gelatin | 1.0 |
| Layer 5: An interlayer, IL-2 | |
| Gelatin | 0.8 |
| Layer 6: A low-speed green-sensitive emulsion layer, GL | |
| Silver iodobromide emulsion, Em-1 | 0.8 |
| Sensitizing dye, S-4 | $5 \times 10^{-4}$ mol/mol Ag |
| Sensitizing dye, S-5 | $1 \times 10^{-4}$ mol/mol Ag |
| Magenta coupler, M-1 | 0.5 |
| Colored magenta coupler, CM-1 | 0.05 |
| DIR compound, D-3 | 0.015 |
| DIR compound, D-4 | 0.020 |
| High boiling solvent, Oil-2 | 0.5 |
| Gelatin | 1.2 |
| Layer 7: An interlayer, IL-3 | |
| Gelatin | 0.8 |
| High boiling solvent, Oil-1 | 0.2 |
| Layer 8: A high-speed green-sensitive emulsion layer, GH | |
| Silver iodobromide emulsion, Em-3 | 1.2 |
| Sensitizing dye, S-6 | $1.5 \times 10^{-4}$ mol/mol Ag |
| Sensitizing dye, S-7 | $2.5 \times 10^{-4}$ mol/mol Ag |

-continued

| Sample-1 | |
|---|---|
| Sensitizing dye, S-8 | $0.5 \times 10^{-4}$ mol/mol Ag |
| Magenta coupler, M-2 | 0.06 |
| Magenta coupler, M-3 | 0.18 |
| Colored magenta coupler, CM-2 | 0.05 |
| DIR compound, D-3 | 0.01 |
| High boiling solvent, Oil-3 | 0.5 |
| Gelatin | 1.0 |
| Layer 9: A yellow filter layer, YC | |
| Yellow colloidal silver | 0.1 |
| Anti-color-staining agent, SC-1 | 0.1 |
| High boiling solvent, Oil-3 | 0.1 |
| Gelatin | 0.8 |
| Layer 10: A low-speed blue-sensitive emulsion layer, BL | |
| Silver iodobromide emulsion, Em-1 | 0.20 |
| Silver iodobromide emulsion, Em-2 | 0.20 |
| Sensitizing dye, S-10 | $7 \times 10^{-4}$ mol/mol Ag |
| Yellow coupler, Y-1 | 0.6 |
| Yellow coupler, Y-2 | 0.12 |
| DIR compound, D-2 | 0.01 |
| High boiling solvent, Oil-3 | 0.15 |
| Gelatin | 1.1 |
| Layer 11: A high-speed blue-sensitive emulsion layer, BH | |
| Silver iodobromide emulsion, Em-4 | 0.40 |
| Silver iodobromide emulsion, Em-1 | 0.20 |
| Sensitizing dye, S-9 | $1 \times 10^{-4}$ mol/mol Ag |
| Sensitizing dye, S-10 | $3 \times 10^{-4}$ mol/mol Ag |
| Yellow coupler, Y-1 | 0.36 |
| Yellow coupler, Y-2 | 0.06 |
| High boiling solvent, Oil-3 | 0.07 |
| Gelatin | 1.0 |
| Layer 12: The 1st protective layer, PRO-1 | |
| Fine-grain silver iodobromide emulsion, Average grain size: 0.06 μm, AgI content: 2 mol % | 0.4 |
| UV absorbent, UV-1 | 0.10 |
| UV absorbent, UV-2 | 0.05 |
| High boiling solvent, Oil-1 | 0.1 |
| High boiling solvent, Oil-4 | 0.1 |
| Formalin scavenger, HS-1 | 0.5 |
| Formalin scavenger, HS-2 | 0.2 |
| Gelatin | 0.8 |
| Layer 13: The 2nd protective layer, PRO-2 | |
| Surfactant, Su-1 | 0.005 |
| Alkali-soluble matting agent, Average grain size: 2 μm | 0.10 |
| Cyan dye, AIC-1 | 0.005 |

-continued

| Sample-1 | |
|---|---|
| Magenta dye, AIM-1 | 0.01 |
| Lubricant, WAX-1 | 0.04 |
| Gelatin | 0.6 |

Each of the above-mentioned layers was further added with coating assistant Su-2, dispersion assistant Su-3, hardeners H-1 and H-2, antiseptics DI-1, stabilizer Stab-1 and antifoggants AF-1 and AF-2, besides the above-given compositions.

| | |
|---|---|
| Em-1: | A monodisperse type emulsion containing a low percentage of silver iodide on the surface; Average grain size: 0.46 μm Average silver iodide content: 7.5% |
| Em-2: | A monodisperse type emulsion having a uniform composition; Average grain size: 0.32 μm Average silver iodide content: 2.0% |
| Em-3 | A monodisperse type emulsion containing a low percentage of silver iodide on the surface; Average grain size: 0.78 μm Average silver iodide content: 6.0% |
| Em-4: | A monodisperse type emulsion containing a low percentage of silver iodide on the surface; Average grain size: 0.95 μm Average silver iodide content: 8.0% |

Em-1, Em-3 and Em-4 each are silver iodobromide emulsions prepared with reference to each of Japanese Patent O.P.I. Publication Nos. 60-138538/1985 and 61-245151/1986 so that they may have a multilayered struture and compride mainly octahedral grains.

Also, in the emulsions Em-1 through Em-4, the ratios of their grain-sizes to the average grain-thicknesss were 1.0, and the ranges of their grain distributions were 14, 10, 12 and 12%, respectively.

The above-mentioned sample-1 is a light-sensitive material having a dried layer thickness within the scope of the invention, because its aggregate dried layer thickness was 16.5 μm. The thicknesses of Layer 6 to Layer 13 were 9 μm each.

S-1

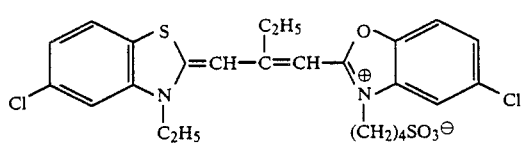

S-2

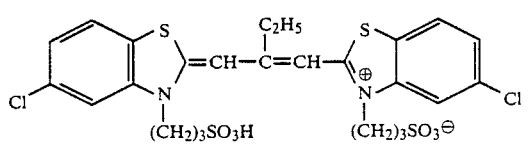

S-3

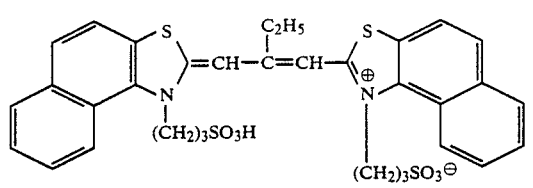

-continued
S-4
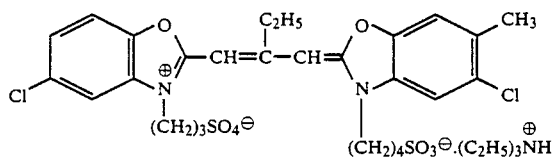
S-5
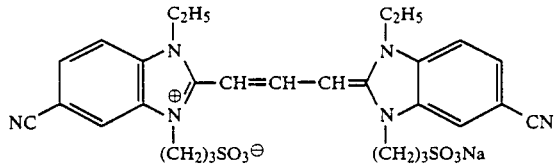
S-6
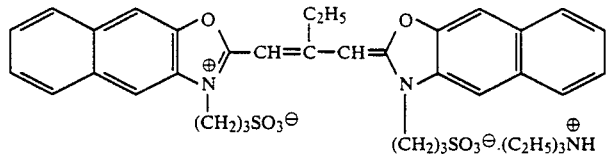
S-7
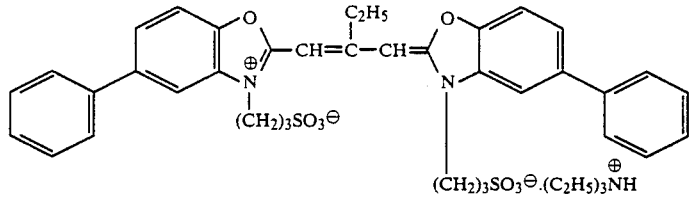
S-8
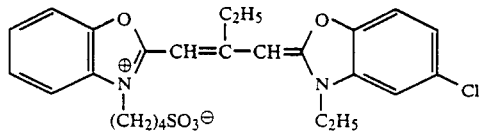
S-9
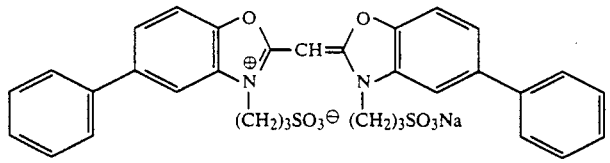
S-10
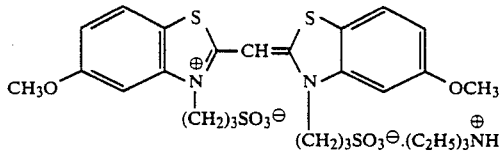
C-1
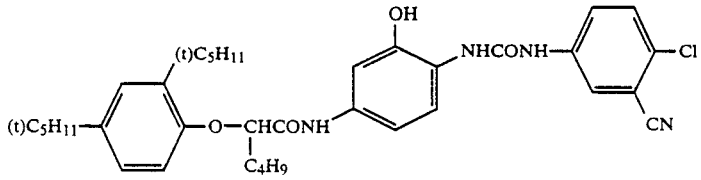
C-2
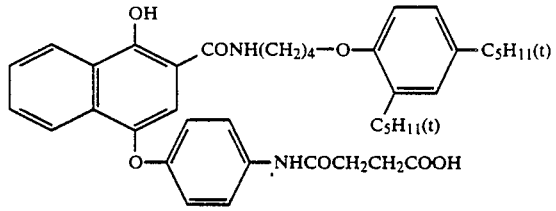

-continued
C-3
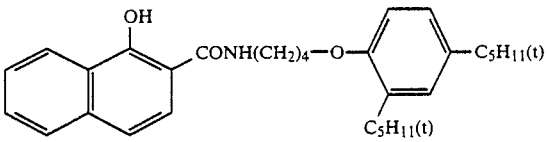
C-4
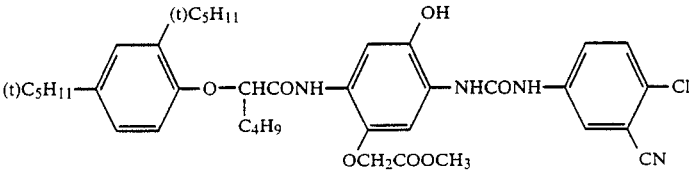
M-1
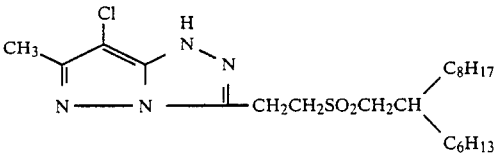
M-2
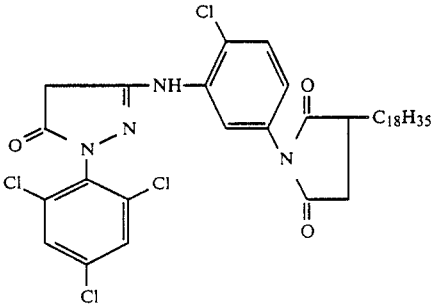
M-3
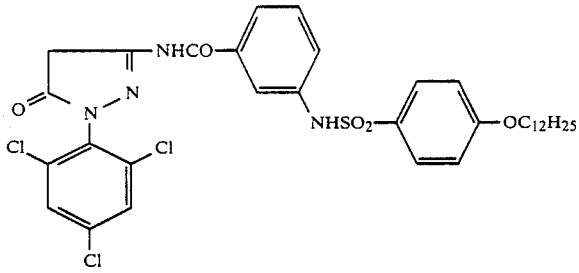
Y-1
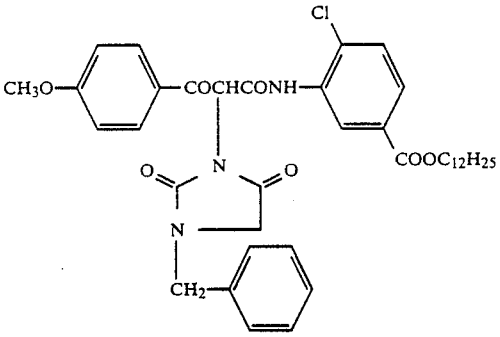

-continued
Y-2
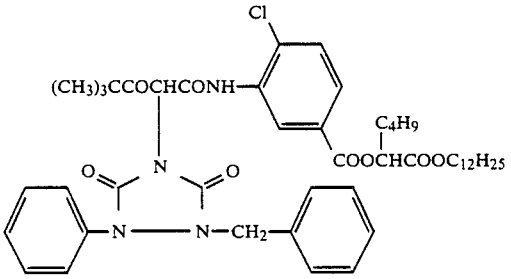
CC-1
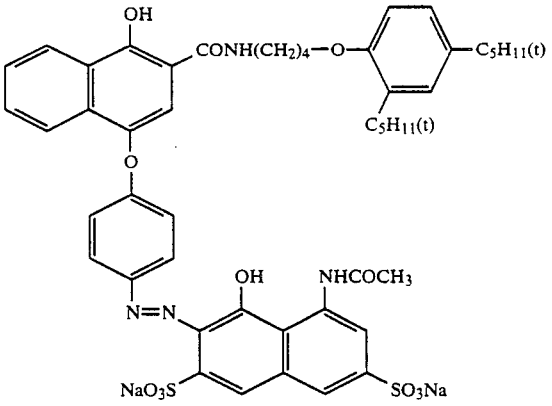
CM-1
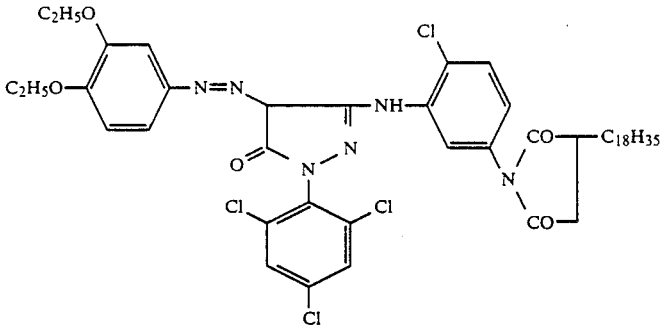
CM-2
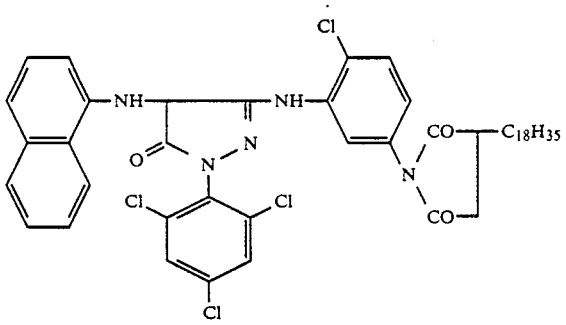

-continued
D-1
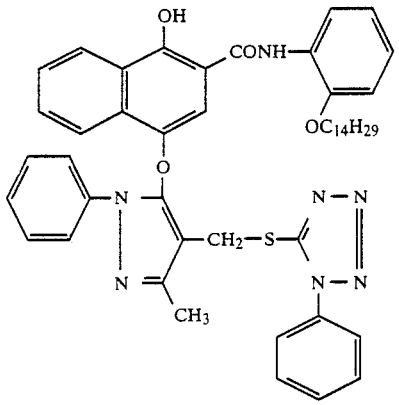
D-2
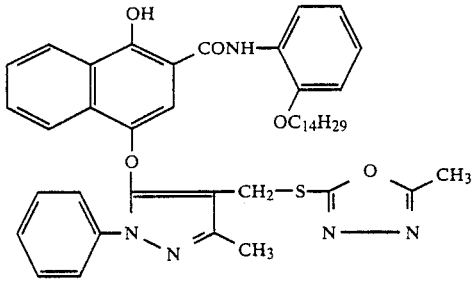
D-3
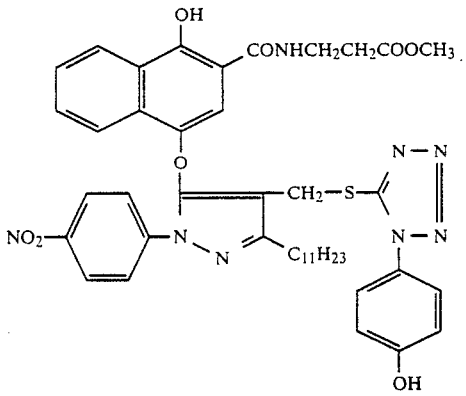
D-4
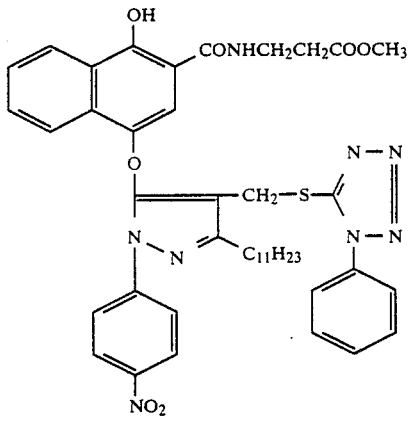

-continued
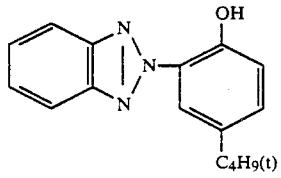
UV-1
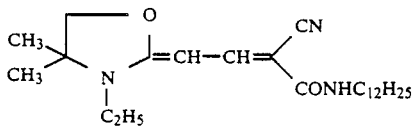
UV-2
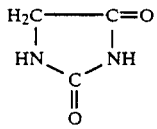
HS-1
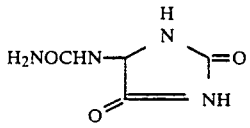
HS-2
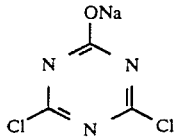
H-1
$[(CH_2{=}CHSO_2CH_2)_3CCH_2SO_2(CH_2)_2]_2N(CH_2)_2SO_3K$
H-2
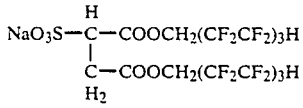
Su-1
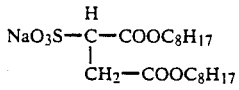
Su-2
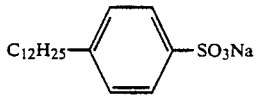
Su-3
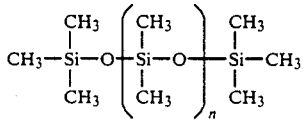
WAX-1
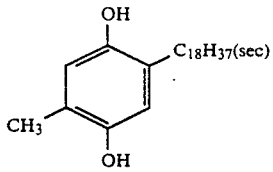
Sc-1

-continued
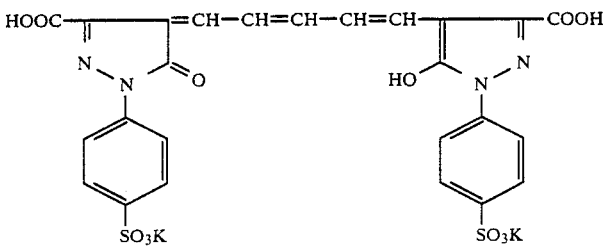
AIC-1
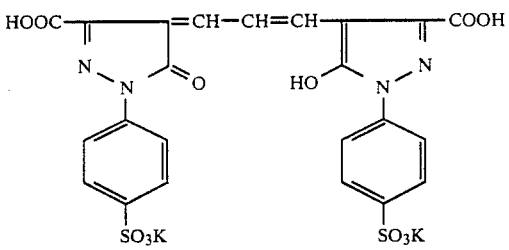
AIM-1
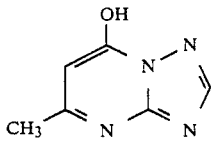
Stab-1
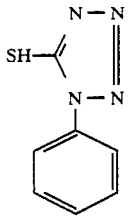
AF-1
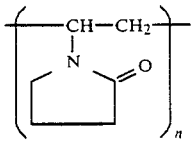
AF-2
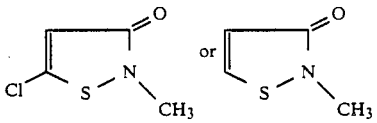
DI-1
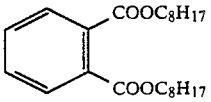
Oil-1
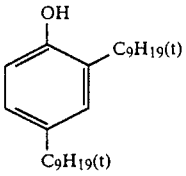
Oil-3
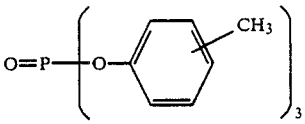

-continued

Oil-4

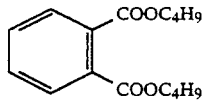

Sample-2 through Sample-5 each were prepared in the same manner as in the above-mentioned Sample-1, except that the amount of gelatin coated was so changed as to make the aggregate layer thickness from 16.5 μm to 17.5 μm, 19.0 μm, 15.0 μm and 13.0 μm, respectively. The layer thicknesses each of Samples-1, 4 and 5 were within the scope of the invention, while the aggregate layer thicknesses each of Samples-3 and 2 were out of the scope of the invention. Other components than the gelatin were coated in the same amount as in Sample-1.

Each of the samples thus prepared was exposed to white light through a wedge and were then processed in the conditions of the following processing steps, processing periods of time and processing temperatures shown in the table below. The samples were then subjected to Experiments No. 1 through No. 30 as shown in Table-1.

| Processing step | Processing time | Processing temperature |
|---|---|---|
| Color developing | 3 min 15 sec | 38° C. |
| Bleaching | 45 sec | 38° C. |
| Fixing | 1 min 45 sec | 38° C. |
| Stabilizing | 50 sec | 38° C. |
| Drying | 1 min | 40 to 70° C. |

The composition of the color developer used therein was as follows.

| | |
|---|---|
| Potassium carbonate | 30 g |
| Sodium hydrogencarbonate | 2.5 g |
| Potassium sulfite | 5 g |
| Sodium bromide | 1.3 g |
| Potassium iodide | 2 mg |
| Hydroxylamine sulfate | 2.5 g |
| Sodium chloride | 0.6 g |
| 4-amino-3-methyl-N-ethyl-N-(β-hydroxyethyl)aniline sulfate | 4.8 g |
| Potassium hydroxide | 1.2 g |
| Add water to make | 1 liter |
| Adjust pH with potassium hydroxide or a 20% sulfuric acid solution to be | pH 10.06 |

The composition of the bleaching solution used therein was as follows.

| | |
|---|---|
| The ferric complex salt of the compound represented by Formula A or the comparative compound, EDTA.Fe, shown in Table 1 | 150 g |
| Disodium ethylenediaminetetraacetate | 10 g |
| Ammonium bromide | 10 g |
| Glacial acetic acid | 10 ml |
| The foregoing color developer | 200 ml |
| Add water to make | 1 liter |
| Adjust pH with aqueous ammonia or glacial acetic acid to | pH 5.8 |

The composition of the fixing solution used therein was as follows.

| | |
|---|---|
| Ammonium thiosulfate | 150 g |
| Sodium bisulfite, anhydrous | 12 g |
| Sodium metabisulfite | 2.5 g |
| Disodium ethylenediaminetetraacetate | 0.5 g |
| Sodium carbonate | 10 g |
| The foregoing bleaching solution | 100 ml |
| Add water to make | 1 liter |
| Adjust pH with acetic acid or aqueous ammonia to | pH 7.0 |

The composition of the stabilizer used therein wa as follows.

| | |
|---|---|
| Formaldehyde, in a 37% aqueous solution | 2 ml |
| 5-chloro-2-methyl-4-isothiazoline-3-one | 0.05 g |
| Emulgen 810 (Surfactant) | 1 ml |
| Additional compound of formaldehyde and sodium bisulfite | 2 g |
| Add water to make | 1 liter |
| Adjust pH with aqueous ammonia or a 50% sulfuric acid solution to | pH 7.0 |

With respect to each of the samples thus processed to have images in the above-mentioned process, the sharpness, i.e., Modulation Transfer Function (MTF), desilvering and bleach-fogging properties and image preservability thereof were measured, respectively. Table-1 shows the results.

About the sharpness, the MTF values were obtained in the following manner. Each sample was exposed to light by making use of a square-wave chart. The resulted image density of each sample was measured through a slit of 300 μm long and 2 μm wide of a Sakura microdensitometer, Model PDM-5, Type-AR, (manufactured by Konica Corporation) with red-light. Then, the MTF values of the samples were obtained.

To be more concrete, the MTF values of the samples obtained at a spatial frequency of 30 lines/mm are shown by a relative value to the value obtained in Experiment-1 regarded as a value of 100.

The desilvering property of each sample was evaluated in the following manner. With respect to each sample obtained after it was devloped, the residual silver remaining in an edge portion corresponding to the same exposure was measured in an X-ray fluorescent silver analysis method.

About the image preservability, the evaluation thereof was made in the following manner. Each of the processed film samples was stored for 8 days at 70° C. and 75% RH, and the blue transmission density in the same portion of each sample was measured. After then, the preservability of each sample was evaluated by the difference of the dye densities between the pre-storage and the post-storage.

Grade A : No difference found in density,

Grade B : Some difference found in density, and

Grade C : Substantial difference found in density.

Densities of bleach-fog and yellow stain were measured at a non-image portion of each processed sample by a transmission densitometer with blue-light.

TABLE 1

| Experiment No. | Total dried layer thickness | Thickness of Layer 5 to 13 | No. of Sample used | Sample to Invention or not | Compound of Formula A or comparative compound each added to bleaching solution | Bleach-fog, yellow stain | Residual silver, (mg/−100 cm$^2$) | Image preservability | MTF | Note |
|---|---|---|---|---|---|---|---|---|---|---|
| 1 | 16.5 | 9.0 | 1 | Invention | EDTA.Fe | 0.07 | 0.80 | C | 100 | Comparative |
| 2 | 17.5 | 10.5 | 2 | Out of invention | EDTA.Fe | 0.08 | 0.80 | C | 91 | Comparative |
| 3 | 19.0 | 11.5 | 3 | Out of invention | EDTA.Fe | 0.11 | 0.90 | C | 80 | Comparative |
| 4 | 15.0 | 8.0 | 4 | Invention | EDTA.Fe | 0.06 | 0.80 | B | 110 | Comparative |
| 5 | 13.0 | 7.5 | 5 | Invention | EDTA.Fe | 0.05 | 0.80 | B | 120 | Comparative |
| 6 | 16.5 | 9.0 | 1 | Invention | A-1 | 0.02 | 0.30 | A | 100 | Invention |
| 7 | 17.5 | 10.5 | 2 | Out of invention | A-1 | 0.05 | 0.50 | B | 90 | Comparative |
| 8 | 19.0 | 11.5 | 3 | Out of invention | A-1 | 0.07 | 0.70 | C | 79 | Comparative |
| 9 | 15.0 | 8.0 | 4 | Invention | A-1 | 0.02 | 0.30 | A | 112 | Invention |
| 10 | 13.0 | 7.5 | 5 | Invention | A-1 | 0.02 | 0.30 | A | 115 | Invention |
| 11 | 16.5 | 9.0 | 1 | Invention | A-3 | 0.02 | 0.30 | A | 102 | Invention |
| 12 | 17.5 | 10.5 | 2 | Out of invention | A-3 | 0.05 | 0.60 | B | 89 | Comparative |
| 13 | 19.0 | 11.5 | 3 | Out of invention | A-3 | 0.07 | 0.70 | C | 79 | Comparative |
| 14 | 15.0 | 8.0 | 4 | Invention | A-3 | 0.02 | 0.30 | A | 112 | Invention |
| 15 | 13.0 | 7.5 | 5 | Invention | A-3 | 0.02 | 0.30 | A | 124 | Invention |
| 16 | 16.5 | 9.0 | 1 | Invention | A-7 | 0.02 | 0.30 | A | 100 | Invention |
| 17 | 17.5 | 10.5 | 2 | Out of invention | A-7 | 0.05 | 0.60 | B | 90 | Comparative |
| 18 | 19.0 | 11.5 | 3 | Out of invention | A-7 | 0.07 | 0.80 | C | 80 | Comparative |
| 19 | 15.0 | 8.0 | 4 | Invention | A-7 | 0.02 | 0.30 | A | 115 | Invention |
| 20 | 13.0 | 7.5 | 5 | Invention | A-7 | 0.02 | 0.30 | A | 125 | Invention |
| 21 | 16.5 | 9.0 | 1 | Invention | EDTA.Fe: A-1 = 1:2 | 0.02 | 0.30 | A | 100 | Invention |
| 22 | 17.5 | 10.5 | 2 | Out of invention | EDTA.Fe: A-1 = 1:2 | 0.05 | 0.60 | C | 88 | Comparative |
| 23 | 19.0 | 11.5 | 3 | Out of invention | EDTA.Fe: A-1 = 1:2 | 0.08 | 0.80 | C | 79 | Comparative |
| 24 | 15.0 | 8.0 | 4 | Invention | EDTA.Fe: A-1 = 1:2 | 0.02 | 0.30 | A | 112 | Invention |
| 25 | 13.0 | 7.5 | 5 | Invention | EDTA.Fe: A-1 = 1:2 | 0.02 | 0.30 | A | 123 | Invention |
| 26 | 16.5 | 9.0 | 1 | Invention | EDTA.Fe: A-6 = 1:2 | 0.02 | 0.30 | A | 101 | Invention |
| 27 | 17.5 | 10.5 | 2 | Out of invention | EDTA.Fe: A-6 = 1:2 | 0.05 | 0.60 | C | 89 | Comparative |
| 28 | 19.0 | 11.5 | 3 | Out of invention | EDTA.Fe: A-6 = 1:2 | 0.08 | 0.80 | C | 78 | Comparative |
| 29 | 15.0 | 8.0 | 4 | Invention | EDTA.Fe: A-6 = 1:2 | 0.02 | 0.30 | A | 111 | Invention |
| 30 | 13.0 | 7.5 | 5 | Invention | EDTA.Fe: A-6 = 1:2 | 0.02 | 0.30 | A | 123 | Invention |

In Table-1, it is meant in Experiment No. 21 through 30 that EDTA.Fe and Exemplified compound A-1 or A-6 were mixedly used in a mole ratio of 1 to 2. The total amount of the compounds was held on 90 g.

From Table-1, it is found that the samples prepared in the processing method relating to the invention are excellent in sharpness and remarkable in improvement effects on the properties of bleach-fogging, desilvering and image preservability.

Example-2

The samples of this example were processed in the same manner as in Example-1, except that some parts of the composition of the bleaching solution used in Example-1 were changed as follows.

Three groups of bleaching solutions were prepared in which the compound represented by Formula-A or EDTA used for the comparison were contained in the following amount:

Solutions of Group 1 each contained 0.5 g of the compounds given in Table-2,

Solutions of Group 2 each contained 21 g of the compound given in Table-3, and

Solutions of Group 3 each contained 190 g of the compound given in Table-4.

The amounts of the compounds each contained in the solutions of Groups 1 and 3 were out of the scope of the invention. The results of tests using the bleaching solutions of Groups 1, 2 and 3 are shown in Tables 2, 3 and 4, respectively.

From Table-2 through Table-4, it can be found that only the samples given in Table-3, processed in the method relating to the invention, were excellent in image sharpness and very effectively improved in bleach-fogginess, desilvering property, and image preservability.

TABLE 2

| Experiment No. | Total dried layer thickness | Thickness of Layer 5 to 13 | No. of Sample used | Sample to Invention or not | Compound of Formula A or comparative compound each added to bleaching solution | Bleach-fog, yellow stain | Residual silver, (mg/−100 cm$^2$) | Image preservability | MTF | Note |
|---|---|---|---|---|---|---|---|---|---|---|
| 1 | 16.5 | 9.0 | 1 | Invention | EDTA.Fe | 0.16 | 1.70 | C | 100 | Comparative |
| 2 | 17.5 | 10.5 | 2 | Out of invention | EDTA.Fe | 0.17 | 1.70 | C | 87 | Comparative |
| 3 | 19.0 | 11.5 | 3 | Out of invention | EDTA.Fe | 0.19 | 1.80 | C | 78 | Comparative |
| 4 | 15.0 | 8.0 | 4 | Invention | EDTA.Fe | 0.15 | 1.70 | C | 107 | Comparative |
| 5 | 13.0 | 7.5 | 5 | Invention | EDTA.Fe | 0.14 | 1.60 | C | 115 | Comparative |
| 6 | 16.5 | 9.0 | 1 | Invention | A-1 | 0.08 | 0.90 | B | 100 | Comparative |
| 7 | 17.5 | 10.5 | 2 | Out of invention | A-1 | 0.10 | 1.50 | C | 86 | Comparative |
| 8 | 19.0 | 11.5 | 3 | Out of invention | A-1 | 0.13 | 1.60 | C | 78 | Comparative |
| 9 | 15.0 | 8.0 | 4 | Invention | A-1 | 0.07 | 0.90 | B | 108 | Comparative |
| 10 | 13.0 | 7.5 | 5 | Invention | A-1 | 0.07 | 0.90 | B | 115 | Comparative |
| 11 | 16.5 | 9.0 | 1 | Invention | A-3 | 0.09 | 0.90 | C | 101 | Comparative |
| 12 | 17.5 | 10.5 | 2 | Out of invention | A-3 | 0.13 | 1.40 | C | 87 | Comparative |
| 13 | 19.0 | 11.5 | 3 | Out of invention | A-3 | 0.14 | 1.50 | C | 78 | Comparative |
| 14 | 15.0 | 8.0 | 4 | Invention | A-3 | 0.08 | 0.90 | B | 109 | Comparative |
| 15 | 13.0 | 7.5 | 5 | Invention | A-3 | 0.08 | 0.80 | B | 117 | Comparative |
| 16 | 16.5 | 9.0 | 1 | Invention | A-7 | 0.09 | 0.90 | C | 100 | Comparative |
| 17 | 17.5 | 10.5 | 2 | Out of invention | A-7 | 0.15 | 1.40 | C | 86 | Comparative |
| 18 | 19.0 | 11.5 | 3 | Out of invention | A-7 | 0.17 | 1.50 | C | 76 | Comparative |
| 19 | 15.0 | 8.0 | 4 | Invention | A-7 | 0.09 | 0.09 | B | 110 | Comparative |
| 20 | 13.0 | 7.5 | 5 | Invention | A-7 | 0.08 | 0.08 | B | 118 | Comparative |
| 21 | 16.5 | 9.0 | 1 | Invention | EDTA.Fe: A-1 = 1:2 | 0.10 | 0.90 | B | 100 | Comparative |
| 22 | 17.5 | 10.5 | 2 | Out of invention | EDTA.Fe: A-1 = 1:2 | 0.15 | 1.50 | C | 86 | Comparative |
| 23 | 19.0 | 11.5 | 3 | Out of invention | EDTA.Fe: A-1 = 1:2 | 0.15 | 1.60 | C | 75 | Comparative |
| 24 | 15.0 | 8.0 | 4 | Invention | EDTA.Fe: A-1 = 1:2 | 0.10 | 0.90 | C | 111 | Comparative |
| 25 | 13.0 | 7.5 | 5 | Invention | EDTA.Fe: A-1 = 1:2 | 0.08 | 0.80 | B | 118 | Comparative |
| 26 | 16.5 | 9.0 | 1 | Invention | EDTA.Fe: A-6 = 1:2 | 0.09 | 0.80 | C | 100 | Comparative |
| 27 | 17.5 | 10.5 | 2 | Out of invention | EDTA.Fe: A-6 = 1:2 | 0.17 | 1.60 | C | 86 | Comparative |
| 28 | 19.0 | 11.5 | 3 | Out of invention | EDTA.Fe: A-6 = 1:2 | 0.16 | 1.60 | C | 77 | Comparative |
| 29 | 15.0 | 8.0 | 4 | Invention | EDTA.Fe: A-6 = 1:2 | 0.09 | 0.80 | C | 110 | Comparative |
| 30 | 13.0 | 7.5 | 5 | Invention | EDTA.Fe: A-6 = 1:2 | 0.09 | 0.80 | B | 118 | Comparative |

TABLE 3

| Experiment No. | Total dried layer thickness | Thickness of Layer 5 to 13 | No. of Sample used | Sample to Invention or not | Compound of Formula A or comparative compound each added to bleaching solution | Bleach-fog, yellow stain | Residual silver, (mg/−100 cm$^2$) | Image preservability | MTF | Note |
|---|---|---|---|---|---|---|---|---|---|---|
| 1 | 16.5 | 9.0 | 1 | Invention | EDTA.Fe | 0.08 | 0.80 | C | 100 | Comparative |
| 2 | 17.5 | 10.5 | 2 | Out of invention | EDTA.Fe | 0.09 | 0.90 | C | 92 | Comparative |
| 3 | 19.0 | 11.5 | 3 | Out of invention | EDTA.Fe | 0.10 | 0.90 | C | 80 | Comparative |
| 4 | 15.0 | 8.0 | 4 | Invention | EDTA.Fe | 0.08 | 0.90 | B | 109 | Comparative |
| 5 | 13.0 | 7.5 | 5 | Invention | EDTA.Fe | 0.07 | 0.80 | B | 120 | Comparative |
| 6 | 16.5 | 9.0 | 1 | Invention | A-1 | 0.04 | 0.40 | A | 100 | Invention |
| 7 | 17.5 | 10.5 | 2 | Out of invention | A-1 | 0.07 | 0.60 | B | 90 | Comparative |
| 8 | 19.0 | 11.5 | 3 | Out of invention | A-1 | 0.08 | 0.70 | C | 78 | Comparative |
| 9 | 15.0 | 8.0 | 4 | Invention | A-1 | 0.03 | 0.30 | A | 110 | Invention |
| 10 | 13.0 | 7.5 | 5 | Invention | A-1 | 0.03 | 0.30 | A | 122 | Invention |
| 11 | 16.5 | 9.0 | 1 | Invention | A-3 | 0.02 | 0.40 | A | 101 | Invention |
| 12 | 17.5 | 10.5 | 2 | Out of invention | A-3 | 0.05 | 0.70 | B | 89 | Comparative |

TABLE 3-continued

| Experiment No. | Total dried layer thickness | Thickness of Layer 5 to 13 | No. of Sample used | Sample to Invention or not | Compound of Formula A or comparative compound each added to bleaching solution | Bleach-fog, yellow stain | Residual silver, (mg/−100 cm²) | Image preservability | MTF | Note |
|---|---|---|---|---|---|---|---|---|---|---|
| 13 | 19.0 | 11.5 | 3 | Out of invention | A-3 | 0.08 | 0.80 | C | 77 | Comparative |
| 14 | 15.0 | 8.0 | 4 | Invention | A-3 | 0.03 | 0.30 | A | 111 | Invention |
| 15 | 13.0 | 7.5 | 5 | Invention | A-3 | 0.02 | 0.30 | A | 124 | Invention |
| 16 | 16.5 | 9.0 | 1 | Invention | A-7 | 0.02 | 0.30 | A | 100 | Invention |
| 17 | 17.5 | 10.5 | 2 | Out of invention | A-7 | 0.06 | 0.60 | B | 90 | Comparative |
| 18 | 19.0 | 11.5 | 3 | Out of invention | A-7 | 0.07 | 0.90 | C | 80 | Comparative |
| 19 | 15.0 | 8.0 | 4 | Invention | A-7 | 0.03 | 0.30 | A | 117 | Invention |
| 20 | 13.0 | 7.5 | 5 | invention | A-7 | 0.03 | 0.30 | A | 126 | Invention |
| 21 | 16.5 | 9.0 | 1 | Invention | EDTA.Fe: A-1 = 1:2 | 0.03 | 0.40 | A | 100 | Invention |
| 22 | 17.5 | 10.5 | 2 | Out of invention | EPTA.Fe: A-1 = 1:2 | 0.06 | 0.70 | C | 87 | Comparative |
| 23 | 19.0 | 11.5 | 3 | Out of invention | EDTA.Fe: A-1 = 1:2 | 0.07 | 0.90 | C | 80 | Comparative |
| 24 | 15.0 | 8.0 | 4 | Invention | EDTA.Fe: A-1 = 1:2 | 0.02 | 0.30 | A | 113 | Invention |
| 25 | 13.0 | 7.5 | 5 | Invention | EDTA.Fe: A-1 = 1:2 | 0.02 | 0.30 | A | 123 | Invention |
| 26 | 16.5 | 9.0 | 1 | Invention | EDTA.Fe: A-6 = 1:2 | 0.03 | 0.40 | A | 102 | Invention |
| 27 | 17.5 | 10.5 | 2 | Out of invention | EDTA.Fe: A-6 = 1:2 | 0.06 | 0.70 | C | 87 | Comparative |
| 28 | 19.0 | 11.5 | 3 | Out of invention | EDTA.Fe: A-6 = 1:2 | 0.08 | 0.90 | C | 78 | Comparative |
| 29 | 15.0 | 8.0 | 4 | Invention | EDTA.Fe: A-6 = 1:2 | 0.02 | 0.30 | A | 112 | Invention |
| 30 | 13.0 | 7.5 | 5 | Invention | EDTA.Fe: A-6 = 1:2 | 0.02 | 0.30 | A | 123 | Invention |

TABLE 4

| Experiment No. | Total dried layer thickness | Thickness of Layer 5 to 13 | No. of Sample used | Sample to Invention or not | Compound of Formula A or comparative compound each added to bleaching solution | Bleach-fog, yellow stain | Residual silver, (mg/−100 cm²) | Image preservability | MTF | Note |
|---|---|---|---|---|---|---|---|---|---|---|
| 1 | 16.5 | 9.0 | 1 | Invention | EDTA.Fe | 0.09 | 0.90 | C | 100 | Comparative |
| 2 | 17.5 | 10.5 | 2 | Out of invention | EDTA.Fe | 0.11 | 1.00 | C | 88 | Comparative |
| 3 | 19.0 | 11.5 | 3 | Out of invention | EDTA.Fe | 0.13 | 1.10 | C | 79 | Comparative |
| 4 | 15.0 | 8.0 | 4 | Invention | EDTA.Fe | 0.08 | 0.90 | C | 108 | Comparative |
| 5 | 13.0 | 7.5 | 5 | Invention | EDTA.Fe | 0.07 | 0.80 | C | 118 | Comparative |
| 6 | 16.5 | 9.0 | 1 | Invention | A-1 | 0.06 | 0.50 | B | 100 | Comparative |
| 7 | 17.5 | 10.5 | 2 | Out of invention | A-1 | 0.09 | 0.70 | C | 90 | Comparative |
| 8 | 19.0 | 11.5 | 3 | Out of invention | A-1 | 0.09 | 0.90 | C | 80 | Comparative |
| 9 | 15.0 | 8.0 | 4 | Invention | A-1 | 0.05 | 0.40 | B | 111 | Comparative |
| 10 | 13.0 | 7.5 | 5 | Invention | A-1 | 0.05 | 0.40 | A | 120 | Comparative |
| 11 | 16.5 | 9.0 | 1 | Invention | A-3 | 0.07 | 0.40 | B | 101 | Comparative |
| 12 | 17.5 | 10.5 | 2 | Out of invention | A-3 | 0.10 | 0.80 | C | 91 | Comparative |
| 13 | 19.0 | 11.5 | 3 | Out of invention | A-3 | 0.11 | 0.90 | C | 80 | Comparative |
| 14 | 15.0 | 8.0 | 4 | Invention | A-3 | 0.06 | 0.50 | B | 112 | Comparative |
| 15 | 13.0 | 7.5 | 5 | Invention | A-3 | 0.05 | 0.40 | B | 119 | Comparative |
| 16 | 16.5 | 9.0 | 1 | Invention | A-7 | 0.06 | 0.50 | B | 101 | Comparative |
| 17 | 17.5 | 10.5 | 2 | Out of invention | A-7 | 0.09 | 0.70 | C | 91 | Comparative |
| 18 | 19.0 | 11.5 | 3 | Out of invention | A-7 | 0.10 | 0.90 | C | 80 | Comparative |
| 19 | 15.0 | 8.0 | 4 | Invention | A-7 | 0.05 | 0.60 | B | 113 | Comparative |
| 20 | 13.0 | 7.5 | 5 | Invention | A-7 | 0.05 | 0.60 | A | 119 | Comparative |
| 21 | 16.5 | 9.0 | 1 | Invention | EDTA.Fe: A-1 = 1:2 | 0.08 | 0.60 | B | 100 | Comparative |
| 22 | 17.5 | 10.5 | 2 | Out of invention | EDTA.Fe: A-1 = 1:2 | 0.10 | 0.70 | C | 85 | Comparative |
| 23 | 19.0 | 11.5 | 3 | Out of invention | EDTA.Fe: A-1 = 1:2 | 0.11 | 0.90 | C | 77 | Comparative |

TABLE 4-continued

| Experiment No. | Total dried layer thickness | Thickness of Layer 5 to 13 | No. of Sample used | Sample to Invention or not | Compound of Formula A or comparative compound each added to bleaching solution | Bleach-fog, yellow stain | Residual silver, (mg/−100 cm²) | Image preservability | MTF | Note |
|---|---|---|---|---|---|---|---|---|---|---|
| 24 | 15.0 | 8.0 | 4 | Invention | EDTA.Fe: A-1 = 1:2 | 0.07 | 0.50 | B | 111 | Comparative |
| 25 | 13.0 | 7.5 | 5 | Invention | EDTA.Fe: A-1 = 1:2 | 0.05 | 0.50 | A | 120 | Comparative |
| 26 | 16.5 | 9.0 | 1 | Invention | EDTA.Fe: A-6 = 1:2 | 0.07 | 0.50 | B | 101 | Comparative |
| 27 | 17.5 | 10.5 | 2 | Out of invention | EDTA.Fe: A-6 = 1:2 | 0.09 | 0.70 | C | 88 | Comparative |
| 28 | 19.0 | 11.5 | 3 | Out of invention | EDTA.Fe: A-6 = 1:2 | 0.10 | 0.80 | C | 79 | Comparative |
| 29 | 15.0 | 8.0 | 4 | Invention | EDTA.Fe: A-6 = 1:2 | 0.06 | 0.50 | B | 109 | Comparative |
| 30 | 13.0 | 7.5 | 5 | Invention | EDTA.Fe: A-6 = 1:2 | 0.05 | 0.40 | A | 121 | Comparative |

Example-3

Sample No. 6 was prepared in the same manner as in Example-1, except that the amounts of silver coated over to each of Layers 3, 4, 6, 8, 10 and 11 of Example-1 were diminished by 10%. The total dried layer thickness of this sample was 16.3 μm and each of the layer thicknesses of from Layer 6 through Layer 13 was 8.9 μm.

Samples No. 7 through No. 17 having an amount of silver coated of 5.56, 4.7, 4.0 and 3.0 g/m² each were prepared by changing the amounts of silver and gelatin each coated on Sample No. 6 so as to have a total dried layer thickness of 17.5 μm and to 14.0 μm, respectively. Thus prepared samples were preserved for two days at 40° C. and 60%RH and were then processed in the same manner as in Example-1. With respect to the samples, the image sharpness (MTF), the desilvering property, the bleach-fogginess and the image preservability of the images obtained on the samples were measured in the same manner as in Example-1.

The image preservability of each sample was measured and evaluated in the same manner as in Example-1, except that the processed film samples were preserved for 14 days at 70° C. and 75%RH.

As is obvious from the results shown in Table-5, it was found that the image sharpness can be excellent and the bleach-fogginess, desilvering property and image preservability can also effectively be improved when a sample has a dried layer thickness relating to the invention of not thicker than 17 μm and an amount of silver coated of 4.7g/m² and the sample is processed with a processing solution containing the compound represented by Formula-A. It was also found that the effect of the invention can be increased by diminishing an amount of silver coated.

TABLE 5

| Experiment No. | Total dried layer thickness | Thickness of Layer 5 to 13 | Silver (g/m²) | No. of Sample used | Compound of Formula A or comparative compound each added to bleaching solution | Bleach-fog, yellow stain | Residual silver, (mg/−100 cm²) | Image preservability | MTF | Note |
|---|---|---|---|---|---|---|---|---|---|---|
| 1 | 16.3 | 8.9 | 5.56 | 6 | EDTA.Fe | 0.12 | 1.10 | C | 100 | Comparative |
| 2 | 16.3 | 8.9 | 4.7 | 7 | EDTA.Fe | 0.11 | 1.00 | C | 101 | Comparative |
| 3 | 16.3 | 8.9 | 4.0 | 8 | EDTA.Fe | 0.11 | 1.00 | C | 100 | Comparative |
| 4 | 16.3 | 8.9 | 3.0 | 9 | EDTA.Fe | 0.09 | 0.90 | C | 99 | Comparative |
| 5 | 17.5 | 10.5 | 5.56 | 10 | EDTA.Fe | 0.14 | 1.10 | C | 92 | Comparative |
| 6 | 17.5 | 10.5 | 4.7 | 11 | EDTA.Fe | 0.12 | 0.90 | C | 90 | Comparative |
| 7 | 17.5 | 10.5 | 4.0 | 12 | EDTA.Fe | 0.11 | 0.90 | C | 88 | Comparative |
| 8 | 17.5 | 10.5 | 3.0 | 13 | EDTA.Fe | 0.10 | 0.80 | C | 88 | Comparative |
| 9 | 14.0 | 7.8 | 5.56 | 14 | EDTA.Fe | 0.12 | 1.00 | C | 118 | Comparative |
| 10 | 14.0 | 7.8 | 4.7 | 15 | EDTA.Fe | 0.11 | 0.90 | C | 117 | Comparative |
| 11 | 14.0 | 7.8 | 4.0 | 16 | EDTA.Fe | 0.10 | 0.80 | B | 115 | Comparative |
| 12 | 14.0 | 7.8 | 3.0 | 17 | EDTA.Fe | 0.08 | 0.80 | B | 115 | Comparative |
| 13 | 16.3 | 8.9 | 5.56 | 6 | A-1 | 0.06 | 0.60 | B | 103 | Invention |
| 14 | 16.3 | 8.9 | 4.7 | 7 | A-1 | 0.03 | 0.30 | A | 101 | Invention |
| 15 | 16.3 | 8.9 | 4.0 | 8 | A-1 | 0.02 | 0.30 | A | 101 | Invention |
| 16 | 16.3 | 8.9 | 3.0 | 9 | A-1 | 0.02 | 0.20 | A | 101 | Invention |
| 17 | 17.5 | 10.5 | 5.56 | 10 | A-1 | 0.09 | 0.80 | C | 90 | Comparative |
| 18 | 17.5 | 10.5 | 4.7 | 11 | A-1 | 0.07 | 0.60 | B | 89 | Comparative |
| 19 | 17.5 | 10.5 | 4.0 | 12 | A-1 | 0.06 | 0.60 | B | 87 | Comparative |
| 20 | 17.5 | 10.5 | 3.0 | 13 | A-1 | 0.05 | 0.50 | A | 85 | Comparative |
| 21 | 14.0 | 7.8 | 5.56 | 14 | A-1 | 0.06 | 0.60 | B | 120 | Comparative |
| 22 | 14.0 | 7.8 | 4.7 | 15 | A-1 | 0.03 | 0.30 | A | 120 | Invention |
| 23 | 14.0 | 7.8 | 4.0 | 16 | A-1 | 0.02 | 0.20 | A | 119 | Invention |
| 24 | 14.0 | 7.8 | 3.0 | 17 | A-1 | 0.02 | 0.20 | A | 121 | Invention |
| 25 | 16.3 | 8.9 | 4.7 | 7 | A-3 | 0.03 | 0.20 | A | 105 | Invention |
| 26 | 16.3 | 8.9 | 4.0 | 8 | A-3 | 0.02 | 0.20 | A | 103 | Invention |
| 27 | 14.0 | 7.8 | 4.7 | 15 | A-3 | 0.02 | 0.30 | A | 122 | Invention |
| 28 | 14.0 | 7.8 | 4.0 | 16 | A-3 | 0.01 | 0.20 | A | 120 | Invention |
| 29 | 16.3 | 8.9 | 4.0 | 8 | EDTA.Fe: | 0.02 | 0.30 | A | 104 | Invention |

TABLE 5-continued

| Experiment No. | Total dried layer thickness | Thickness of Layer 5 to 13 | Silver ($g/m^2$) | No. of Sample used | Compound of Formula A or comparative compound each added to bleaching solution | Bleach-fog, yellow stain | Residual silver, ($mg/-100\ cm^2$) | Image preserv-ability | MTF | Note |
|---|---|---|---|---|---|---|---|---|---|---|
| 30 | 16.3 | 8.9 | 3.0 | 9 | A-1 = 1:2 EDTA.Fe: A-1 = 1:2 | 0.01 | 0.30 | A | 102 | Invention |
| 31 | 14.0 | 7.8 | 4.0 | 16 | EDTA.Fe: A-1 = 1:2 | 0.02 | 0.30 | A | 121 | Invention |
| 32 | 14.0 | 7.8 | 3.0 | 17 | EDTA.Fe: A-1 = 1:2 | 0.01 | 0.20 | A | 121 | Invention |

Example-4

Sample No. 1 through No. 32 each prepared in Example-3 were running processed by making use of both of the processing solutions of Example-3 and the following replenishers.

| | |
|---|---|
| <Color developing replenisher> | |
| Potassium carbonate | 40 g |
| Sodium hydrogencarbonate | 3 g |
| Potassium sulfite | 7 g |
| Sodium bromide | 0.5 g |
| Hydroxylamine sulfate | 3.1 g |
| 4-amino-3-methyl-N-ethyl-N-(β-hydroxylethyl)aniline sulfate | 6.0 g |
| Potassium hydroxide | 2 g |
| Add water to make | 1 liter |
| Adjust pH with potassium hydroxide or a 20% sulfuric acid solution to | pH 10.12 |
| <Bleaching replenisher> | |
| Ferric ammonium ethylenediaminetetraacetate | 200 g |
| Disodium ethylenediaminetetraacetate | 2 g |
| Ammonium bromide | 178 g |
| Glacial acetic acid | 21 ml |
| Add water to make | 1 liter |
| Adjust pH with aqueous ammonia or glacial acetic acid to | pH 5.6 |
| <Fixing replenisher> | |
| Ammonium thiosulfate | 200 g |
| Sodium sulfiate, anhydrous | 15 g |
| Sodium metabisulfite | 3 g |
| Disodium ethylenediaminetetraacetate | 0.8 g |
| Sodium carbonate | 14 g |
| Add water to make | 1 liter |
| Adjust pH to | pH 6.5 |

As for the stabilizing replenisher, the same stabilizer as in Example-1 was used.

In the running process, the processing steps, processing times, processing temperatures and replenishing amounts were as follows.

| Processing step | Processing time | Processing temperature | Replenishing amount* |
|---|---|---|---|
| Color developing | 3 min 15 sec. | 38° C. | 775 ml |
| Bleaching | 45 sec. | 38° C. | 133 ml |
| Fixing | 1 min 45 sec. | 38° C. | 775 ml |
| Stabilizing | 50 sec. | 38° C. | 775 ml |
| Drying | 1 min. | 40 to 70° C. | — |

*Replenishing amount is in terms of a value per sq. meter of a light-sensitive material.

The running process was carried on until the bleaching replenisher was replenished in an amount doubled as much as the capacity of the bleaching tank. After the completion of the running process, the yellow stains produced in the unexposed areas and the residual silver amount in the maximum density area were measured, respectively.

The same experiments were tried as in Example-1, except that the ammonium ethylenediamine tetraacetate contained in the foregoing bleaching replenisher was replaced by the same mols of the compound represented by Formula-A which was used in each of the bleaching solutions of Example-1.

It was resultingly found that the effects of the invention were promoted when the processing method relating to the invention was used.

Example-5

The same procedures as in Example-4 were followed, except that the same bleaching replenisher as in Example-4 was added with the following bleach accelerators in an amount of 1.5 g/liter each; I-1, II-2, II-15, II-24, II-27, III-3, III-13 to III-15, IV-1, V-9, V-10, V-13, VI-1, VII-8, VIII-1, VIII-2, VIII-4, VIII-5, IX-1, and A'-1 and A'-2 which are the imidazole componds for bleach accelerators. A further excellent result was proved in residual silver amount and, particularly, in the case of using a bleach accelerator, III-14, III-15, VIII-1, VIII-4 or VIII-5.

Similar to the above, a further excellent effects can be proved when a fixer and a fixing replenisher are added with the compound FA-1, FA-12, FA-22, FA-32, FA-35, FA-38, FB-1 or FB-4 in an amount of 40 g/liter each and, particularly, in the case of using the compound FA-12, FB-1 or FB-4.

Further, the same fixer and fixing replenisher each as in Example-4 were added with the exemplified compound A-1.Fe in an amount of 100g/liter and the pH values thereof were adjusted to be pH 7.0, and when the same experiments were tried, the nearly the same results were obtained.

What is claimed is:

1. A method for forming color photographic images comprising steps of imagewise exposing to light a silver halide color photographic light-sensitive material, developing said light-sensitive material with a color developer, bleaching, immediately after said step of developing, said light-sensitive material with a bleaching solution for 90 seconds or less, and treating, after said step of bleaching, said light-sensitive material with a solution having fixing capability, wherein said light-sensitive material comprises a support and hydrophilic colloid layers including a silver halide emulsion layer provided on a side of said support, and a total dry thickness of said hydrophilic colloid layers is not more than 17 μm, and an amount of silver in said silver halide contained in said silver halide emulsion layers included in said hydrophilic layers is from 0.5 g/m$^2$ to 4.7 g/m$^2$, and said bleaching solution contains a ferric complex salt of a compound represented by the following Formula A in an amount of within the range of from 0.002 mole to 0.4 mole per liter of said bleaching solution;

Formula A

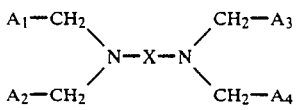

where $A_1$ through $A_4$ are each a —$CH_2OH$ group, a —COOM group, or a —$PO_3M^1M^2$ group, which may be the same with or different, M, $M^1$ and $M^2$ are each a hydrogen atom, a sodium atom, a potassium atom or an ammonium group; X is a substituted or unsubstituted alkylene group having three to five carbon atoms.

2. The method of claim 1, wherein said thickness of said hydrophilic colloid layers is within the range of 5 μm to 17 μm.

3. The method of claim 2, wherein said thickness of said hydrophilic colloid layers is within the range of 10 μm to 16 μm.

4. The method of claim 1, wherein said bleaching solution contains said ferric complex salt of a compound represented by Formula A in an amount of from 0.01 mole to 0.4 mole per liter of said bleaching solution.

5. The method of claim 4, wherein said bleaching solution contains said ferric complex salt of a compound represented by Formula A in an amount of from 0.05 mole to 0.38 mole per liter of said bleaching solution.

6. The method of claim 1, wherein said bleaching solution contains said ferric complex salt of ethylenediaminetetraacetic acid together with said compound represented by Formula A.

7. The method of claim 1, wherein an amount of silver halide contained in silver halide emulsion layers included in said hydrophilic layers is within the range of 1.0 g/m$^2$ to 4.7 g/m$^2$ in terms of silver in total.

8. The method of claim 1, wherein said developing step is performed for not more than 180 seconds.

9. The method of claim 1, wherein said developing step is performed at a temperature within the range of 20° C. to 45° C.

10. The method of claim 1, wherein said bleaching step is performed at a temperature of from 20° C. to 45° C.

11. The method of claim 1, wherein said treating step with a solution having fixing capability is performed for not more than 3 minutes 10 seconds.

12. The method of claim 1, wherein said treating step with a solution having fixing capability is performed at a temperature of from 20° C. to 45° C.

13. The method of claim 1, wherein said bleaching step and said treating step with a solution having fixing capability are performed for not more than 3 minutes 45 seconds in total.

14. The method of claim 1, wherein said solution having fixing capability is a fixing solution.

15. The method of claim 1, wherein said solution having fixing capability is a bleach-fixer.

16. The method of claim 1, wherein at least one of said bleaching solution and said solution having fixing capability contains a bleaching accelerator selected from the group consisting of imidazole and derivative thereof, and compounds represented by the following Formulas I through IX:

Formula I

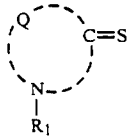

wherein Q is a group of atoms necessary to complete a nitrogen-containing heterocyclic ring including a ring condensed with a 5- or 6-membered unsaturated ring; and $R_1$ is a hydrogen atom, an alkyl atom having 1 to 6 carbon atoms, a cycloalkyl group, an aryl group, a heterocyclic group including those condensed with a 5- or 6-membered unsaturated ring, or an amino group, Formula II

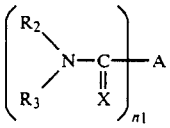

wherein $R_2$ and $R_3$ are each a hydrogen atom, an alkyl group having 1 to 6 carbon atoms, a hydroxy group, a carboxy group, an amino group, an acyl group having 1 to 3 carbon atoms, an aryl group or an alkenyl group;

A is

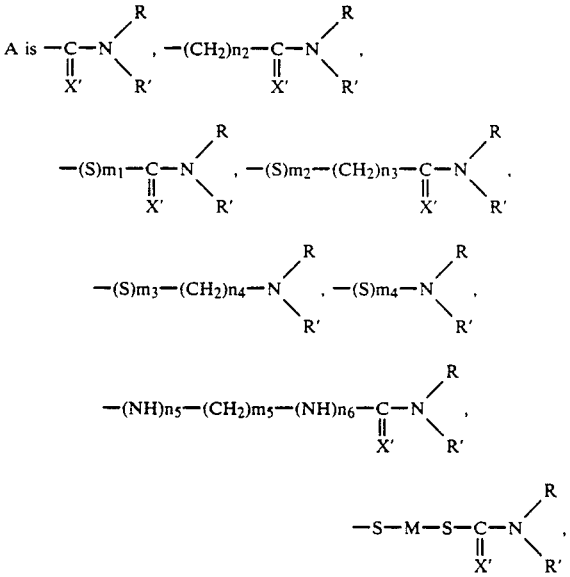

—SZ or $n_1$ valent heterocyclic group including, those condensed with a 5-or 6-membered unsaturated ring; X is =S, =O, or NR'', in which R and R' are each synonymous with $R_2$ and $R_3$, X' is synonymous with X, Z is a hydrogen atom, an alkali metal atom, an ammonium group, an amino group, a nitrogen-containing heterocyclic group, an alkyl group or

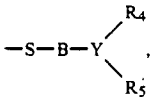

M is a divalent metal atom, R'' is a hydrogen atom, an alkyl group having 1 to 6 carbon atoms, a cycloalkyl group, an aryl group, a heterocyclic group including those condensed with a 5- or 6-membered unsaturated ring or an amino group, $n_1$ to $n_6$ and $m_1$ to $m_5$ are each an integer of 1 to 6, B is an alkylene group having 1 to 6 carbon atoms,

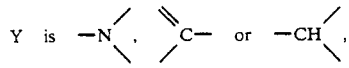

$R_4$ and $R_5$ are each synonymous with $R_2$ and $R_3$, provided that $R_4$ and $R_5$ each may be —B—SZ and that $R_2$ and $R_3$, R and R', and $R_4$ and $R_5$ each may be bonded together to complete a ring, Formula III

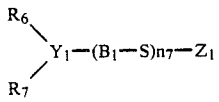

wherein $R_6$ and $R_7$ are each a hydrogen atom, an alkyl group having 1 to 6 carbon atoms, a hydroxy group, a carboxy group, an amino group, an acyl group having 1 to 3 carbon atoms, an aryl group, an alkenyl group, or —$B_1$—S—$Z_1$, provided that $R_6$ and $R_7$ are allowed to bond together to complete a ring; $Y_1$ is N— or CH—; $B_1$ is an alkylene group having 1 to 6 carbon atoms; $Z_1$ is a hydrogen atom, an alkali metal atom, an ammonium group, an amino group, a nitrogen-containing heterocyclic group or

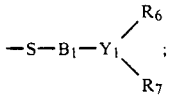

$n_7$ is an integer of 1 to 6,

Formula IV

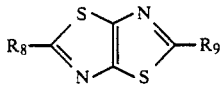

wherein $R_8$ and $R_9$ are each

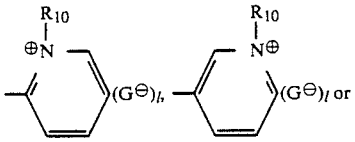

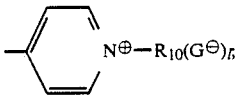

$R_{10}$ is an alkyl group or —$(CH_2)n_8SO_3\theta$, provided that, when $R_{10}$ is —$(CH_2)n_8SO_3\theta$, l is zero and, when $R_{10}$ is an alkyl group, l is 1; $G\theta$ is an anion; and $n_8$ is an integer of 1 to 6, Formula V

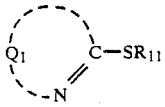

wherein $Q_1$ is a group of atoms necessary to complete a nitrogen-containing heterocyclic ring including those condensed with a 5- or 6-membered unsaturated ring; and $R_{11}$ is a hydrogen atom, an alkali metal atom,

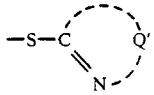

or an alkyl group, in which Q' is synonymous with $Q_1$,

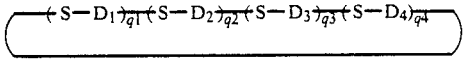

wherein $D_1$, $D_2$, $D_3$ and $D_4$ are each a single linkage, an alkylene group having 1 to 8 carbon atoms or a vinylene group; $q_1$, $q_2$, $q_3$ and $q_4$ are each an integer of 0, 1 or 2; and a ring formed together with a sulfur atom is allowed to be condensed with a saturated or unsaturated 5- or 6-membered ring.

Formula VII

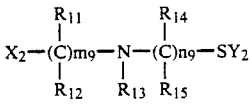

wherein $X_2$ is —COOM', —OH, —$SO_3M'$, —$CONH_2$, —$SO_2NH_2$, —$NH_2$, —SH, —CN, —$CO_2R_{16}$, —$SO_2R_{16}$, —$OR_{16}$, —$NR_{16}R_{17}$, —$SR_{16}$, —$SO_3R_{16}$, —$NHCOR_{16}$, —$NHSO_2R_{16}$ or —$COR_{16}$; $Y_2$ is

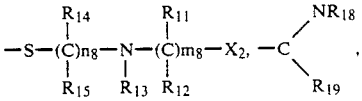

or a hydrogen atom;

$n_8$ and $n_9$ are each an integer of 1 to 10; $R_{11}$, $R_{12}$, $R_{13}$, $R_{14}$, $R_{15}$, $R_{17}$ and $R_{18}$ are each a hydrogen atom, a lower alkyl group, an acyl group or

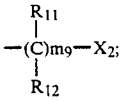

$R_{16}$ is a lower alkyl group; $R_{19}$ is —$NR_{20}R_{21}$, —$OR_{22}$ or —$SR_{22}$; $R_{20}$ and $R_{21}$ are each a hydrogen atom or a lower alkyl group; and $R_{22}$ is a group of atoms necessary to complete a ring upon bonding to $R_{18}$; $R_{20}$ or $R_{21}$ is allowed to complete a ring upon bonding to $R_{18}$; and M' is a hydrogen atom or a cation, Formula VIII

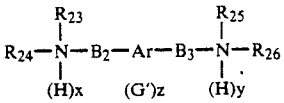

wherein Ar is an arylene group or a divalent organic group completed by combining an aryl group with an oxygen atom and/or an alkylene group; $R_{23}$, $R_{24}$, $R_{25}$ and $R_{26}$ are each a hydroxy-substituted lower alkyl group; $B_2$, $B_3$ are lower alkylene x and y are each an integer of 0 o r 1; G' is an anion; and z is an integer of 0, 1 or 2,

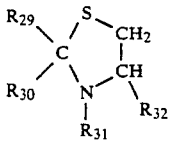

Formula IX wherein $R_{29}$ and $R_{30}$ are each a hydrogen atom, an alkyl group, an aryl group or a heterocyclic group; $R_{31}$ is a hydrogen atom or an alkyl group; and $R_{32}$ is a hydrogen atom or a carboxy group.

* * * * *